US008820198B2

(12) United States Patent
Park

(10) Patent No.: US 8,820,198 B2
(45) **Date of Patent: *Sep. 2, 2014**

(54) AUTOFEED SCREWDRIVING TOOL

(71) Applicant: Simpson Strong-Tie Company, Inc., Pleasanton, CA (US)

(72) Inventor: Jeremy Scott Park, Bethtage, TN (US)

(73) Assignee: Simpson Strong-Tie Company, Inc., Pleasanton, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/012,850

(22) Filed: Aug. 28, 2013

(65) Prior Publication Data

US 2014/0000419 A1 Jan. 2, 2014

Related U.S. Application Data

(63) Continuation of application No. 12/828,018, filed on Jun. 30, 2010, now Pat. No. 8,544,369.

(51) Int. Cl.
*B25B 23/04* (2006.01)

(52) U.S. Cl.
USPC ..... 81/435

(58) Field of Classification Search
USPC ..... 81/57.37, 434, 435, 418, 451–454
See application file for complete search history.

(56) References Cited

U.S. PATENT DOCUMENTS

| | | | |
|---|---|---|---|
| 4,062,388 | A | 12/1977 | DeCaro |
| 4,930,630 | A | 6/1990 | Habermehl |
| 5,337,635 | A | 8/1994 | Habermehl |
| 5,469,767 | A | 11/1995 | Habermehl |
| 5,568,753 | A | 10/1996 | Habermehl |
| 5,699,704 | A | 12/1997 | Habermehl |
| 5,819,609 | A | 10/1998 | Habermehl |
| 5,826,468 | A | 10/1998 | Daubinger et al. |
| 5,839,332 | A | 11/1998 | Fujiyama et al. |
| 5,855,151 | A | 1/1999 | Habermehl |
| 5,870,933 | A | 2/1999 | Habermehl |
| 5,918,512 | A | 7/1999 | Habermehl |
| 5,927,163 | A | 7/1999 | Habermehl |
| 5,934,162 | A | 8/1999 | Habermehl |
| 6,055,891 | A | 5/2000 | Habermehl |
| 6,089,132 | A | 7/2000 | Habermehl |
| 6,138,536 | A | 10/2000 | Chen |
| 6,244,140 | B1 | 6/2001 | Habermehl |

(Continued)

FOREIGN PATENT DOCUMENTS

| | | | |
|---|---|---|---|
| DE | 19537369 | A1 | 4/1996 |
| DE | 20001481 | U1 | 4/2000 |
| EP | 1293299 | A2 | 3/2003 |

OTHER PUBLICATIONS

Office Action dated Sep. 17, 2012, U.S. Appl. No. 12/828,018, filed Jun. 30, 2010.

(Continued)

*Primary Examiner* — Hadi Shakeri
(74) *Attorney, Agent, or Firm* — Vierra Magen Marcus LLP

(57) ABSTRACT

A screwdriver for collated screws in which a tip of the screw projects forwardly of the tool prior to initiation of the screwdriving sequence and, preferably, a forwardly directed socket carried on a retractable nose portion engages the head of the screw to be driven and urges the screw forwardly into a workpiece such that the pinching of the screw between the nose portion and the workpiece initiates retraction of the nose portion preferably leading to engagement of the screw by a rotating driver shaft.

19 Claims, 30 Drawing Sheets

(56) References Cited

U.S. PATENT DOCUMENTS

| | | | |
|---|---|---|---|
| 6,425,306 | B1 | 7/2002 | Habermehl |
| 6,453,634 | B1 | 9/2002 | Pryor |
| 6,453,780 | B2 | 9/2002 | Habermehl |
| 6,494,322 | B1 | 12/2002 | Habermehl et al. |
| 6,601,480 | B1 | 8/2003 | Habermehl |
| 6,647,836 | B1 | 11/2003 | Habermehl |
| 6,783,001 | B2 | 8/2004 | Wollner |
| 6,862,963 | B2 | 3/2005 | Habermehl |
| 6,941,847 | B2 | 9/2005 | Habermehl |
| 6,959,630 | B2 | 11/2005 | Habermehl |
| 7,341,146 | B2 | 3/2008 | Habermehl |
| 7,997,171 | B2 | 8/2011 | Massari et al. |
| 2005/0072276 | A1 | 4/2005 | Lin |
| 2008/0016989 | A1 | 1/2008 | Walker |
| 2008/0216607 | A1 | 9/2008 | Xu |
| 2012/0000327 | A1 | 1/2012 | Park |

OTHER PUBLICATIONS

Response to Office Action dated Mar. 15, 2013, U.S. Appl. No. 12/828,018, filed Jun. 30, 2010.

Notice of Allowance dated May 29, 2013, U.S. Appl. No. 12/828,018 filed Jun. 30, 2010.

14
279
73
72
210
71
13
77
70
74
79
81
80
78
73
76
16
39
110
112
110
42
43
147
17
142
37
16
40
41
41
36
15

AUTOFEED SCREWDRIVING TOOL

CLAIM OF PRIORITY

This application is a continuation of U.S. patent application Ser. No. 12/828,018 filed on Jun. 30, 2010 which issued to U.S. Pat. No. 8,544,369 on Oct. 1, 2013 entitled "AUTOFEED SCREWDRIVING TOOL," by Jeremy Scott Park, incorporated herein by reference in its entirety.

TECHNICAL FIELD

This technology relates to an autofeed screwdriving tool for driving collated screws which are joined together in a strip and, more particularly, to a power screwdriver for use in driving collated screws

BACKGROUND

Autofeed screwdrivers are known for driving collated screws. For example, one known autofeed screwdriver for collated screws is disclosed in U.S. Pat. No. 6,453,780 to Habermehl, issued Sep. 24, 2002, the disclosure of which is incorporated herein by reference. In this patent to Habermehl, a screwstrip comprising a plurality of screws held in spaced relation on a plastic strap are incrementally fed through a guideway into a slide body which is mounted for sliding relative to a housing carrying a rotating drive shaft with a bit for engaging a screw. The slide body has a nose portion for engagement with a work surface. A user engages the nose portion with a workpiece and urges the screwdriving tool forwardly into the workpiece to retract the slide body within the housing and drive a screw coaxially aligned with the driveshaft into a workpiece after which a user discontinues applying forwardly directed forces to the tool. In the cycle of operation of applying forces to the tool to drive each successive screw and then releasing such forces, the slide body is moved reciprocally inwardly and outwardly in the housing which relative movement advances each successive screw in the screwstrip into a position in alignment with the driver shaft for driving into the workpiece.

Various different types of screwstrips are known including screwstrips as disclosed in the above-noted U.S. Pat. No. 6,453,780 and screwstrips of the type disclosed, for example, in U.S. Pat. No. 6,494,322 to Habermehl et al, issued Dec. 17, 2002 and U.S. Pat. No. 6,783,001 to Wollner, issued Oct. 31, 2004.

Such screwstrips have the common features that they include a plurality of screws arranged in a generally side-by-side relation which are held together by a strap which preferably comprises a plastic material but may be formed from various other materials including paper, metal and other materials alone or in combinations. In the screwstrips disclosed in U.S. Pat. Nos. 6,453,780 and 6,494,322 which are referred to herein as "upright strap" screwstraps, these straps holding the screws are elongate not only between the screws but also in a direction parallel the axis of the screws. In contrast, in the screwstrip of the type taught by the patent to Wollner which are referred to herein as "flat tape" screwstrips, the strap is elongate between the screws and in a direction normal the axis of the screws.

Various metal connectors are known for connecting of wide range of wood products with holes pre-formed in the connectors and through which screws are to be passed to secure the connectors to wood surfaces which they overlay. Such connectors are well known and include hangers for joints and rafters, joint ties, hurricane ties, framing anchors, staircase angles, deck post ties and the like. For example, U.S. Pat. No. 6,453,634 to Pryor issued Sep. 24, 2002 illustrates a strap adapted to be secured to the face of a wood member via a plurality of threaded fasteners which are to pass through suitably sized holes in the strap.

The inventor of this application has appreciated a disadvantage which arises with previously known autofeed screwdrivers is that it is difficult to drive a screw into a precise point within a workpiece. For example, the applicant has appreciated that it is difficult with non-autofeed screwdrivers to drive screws accurately through the center of openings in known connection brackets which are sized to closely receive the screw.

The applicant has appreciated a further disadvantage that autofeed screwdrivers do not provide a mechanism whereby a screw to be driven protrudes forwardly from the tool prior to activation of the tool in a manner which permits a bit of a screw to be driven to be placed accurately at the desired location as, for example, centered in the opening through a connection strap.

SUMMARY

To at least partially overcome these disadvantages of the prior art, the present technology provides a screwdriver for collated screws in which a tip of the screw projects forwardly of the tool prior to initiation of the screwdriving sequence.

An object of the present technology is to provide an improved screwdriver for collated screws.

Another object is to provide an improved method of operating a screwdriver for collated screws.

Another object is to provide an improved guideway for flat tape collated screws which facilitates holding the screw to be driven in a desired position parallel to an axis of a driver shaft.

Another object is to provide a screwdriver for collated screwstrips in which in driving a screw, the tip of the screw is the first element to engage a work surface.

Another object is to provide a screwdriver for collated screws in which the pinching of a screw to be driven between the workpiece and the slide body of the tool before the screw is engaged is used to retract a slide body within a housing for the tool.

Accordingly, in one aspect, the present technology provides an apparatus for driving with a power driver a screwstrip comprising threaded fasteners such as screws or the like, which are joined together in a strip comprising:

a housing;

an elongate drive shaft for operative connection to a power driver for rotation thereby and defining a longitudinal axis; a bit at a forward end of the drive shaft for engagement with a head of a screw, a slide body coupled to the housing for displacement parallel to the axis of the drive shaft between an extended position and a retracted position;

the slide body having:

(a) a guide channel for said screwstrip extending through said slide body generally transverse to the axis;

(b) a screw feed activation mechanism coupled between the slide body and the housing whereby displacement of the slide body relative the housing between the extended position and the retracted position advances successive screws through the guide channel to an initial screw position axially in alignment with said drive shaft for engagement in driving of each screw by a bit carried at a forward end of the drive shaft forwardly into a workpiece;

(c) a socket with a forwardly directed surface to engage a rearwardly directed surface of a head of a screw axially in alignment with said drive shaft and urge the screw forwardly, and (d) a forwardly directed touch down foot to engage the workpiece;

wherein with the slide body in the extended position relative the housing the screw in the initial screw position extends forwardly beyond the touch down foot for engagement of a tip of the screw with the workpiece, wherein from the extended position with the screw in the initial position with the tip of the screw engaging the workpiece, on moving the housing forwardly toward the workpiece the forwardly directed surface of the socket engages the rearwardly directed surface of the head of the screw and pinches the screw between the socket and the workpiece causes the housing to move relative the slide body towards the retracted position such that the bit engages the head of the screw rotating the screw and the screw is driven sufficiently forwardly into the workpiece that the touch down foot engages the workpiece, whereupon with continued forward movement of the housing toward the workpiece engagement of the touch down foot with the workpiece causes the housing to move relative the slide body further towards the retracted position such that the bit in continued engagement with the head of the screw drives the screw further into the workpiece.

In another aspect, the present technology provides in an autofeed screwdriving tool an improved arrangement for engaging a shank of a screw including a pair of pivoting guide members disposed on opposite sides of the shank of the screw and movable from an open position to a closed position in which the guide members capture the shank therebetween, the guide members having camming portions which on movement from the open position to the closed position urge the shank of the screw to a desired position coaxial about an axis of a driver shaft to drive the screw.

In another aspect, the present technology provides in an autofeed screwdriving tool an advance pawl to engage and advance a screwstrip in a first advancing direction, the pawl resiliency deflectable laterally of the screwstrip for movement in a second return direction past the screwstrip, the tool also including a pivoting guide member engaged on one lateral side of the screwstrip and movable from an open position to a closed position in which the guide member locates a shank of a screw in a desired position, wherein with the tool in a fully extended position the guide member is manually movable to the open position and on movement to the open position engages the pawl to deflect it laterally out of engagement with the screwstrip to permitting manual insertion or removal of the screwstrip.

In another aspect, the present technology provides an autofeed screwdriving tool with a socket to engage the head of a screw to urge the screw forwardly, the socket having a bore extending rearwardly therefrom through which a driver shaft is extended to engage and rotate the screw head.

In another aspect, the present technology provides an autofeed screw driving tool for a screwstrip, preferably a flat strap screwstrip, in which a guideway for guiding the advance of a strap of the screwstrip is symmetrical about an axis of a driver shaft to drive each successively advanced screw held in the strap such that when the strap is advanced to a location that the head of the screw is coaxial with the axis, the strap holds the screw with its shaft extending from the head substantially coaxially with the axis.

BRIEF DESCRIPTION OF THE DRAWINGS

Further aspects and advantages of the present technology will become apparent from the following description taken together with the accompanying drawings in which:

FIGS. 11 to 21 are schematic pictorial views of the forward portion of the slide body the same as that shown in FIG. 5 but partially cut away and with each of the different FIGS. 11 to 21 representing different relative positions of the various elements during normal use of the tool and, in which:

FIG. 11 illustrates an arrangement with a first guide member in an open position ready for advance of a screwstrip;

FIG. 12 is identical to FIG. 11 but showing a first screw in the screwstrip in a ready position to which the screw is manually advanced;

FIG. 13 schematically illustrates a screw in a ready position as shown in FIG. 2 but with the tip of the screw merely touching without any pressure the surface of a workpiece;

FIGS. 14 to 21 are pictorial views similar to that shown in FIG. 13 but illustrating the sequential positions following the position of FIG. 13 which the elements of the tool assume in driving of a screw into the workpiece in a cycle of operation with, as seen in FIG. 21, the tool returned to the ready position with a next successive screw from the screwstrip but otherwise the same as in FIG. 13;

DETAILED DESCRIPTION

Figure 1:
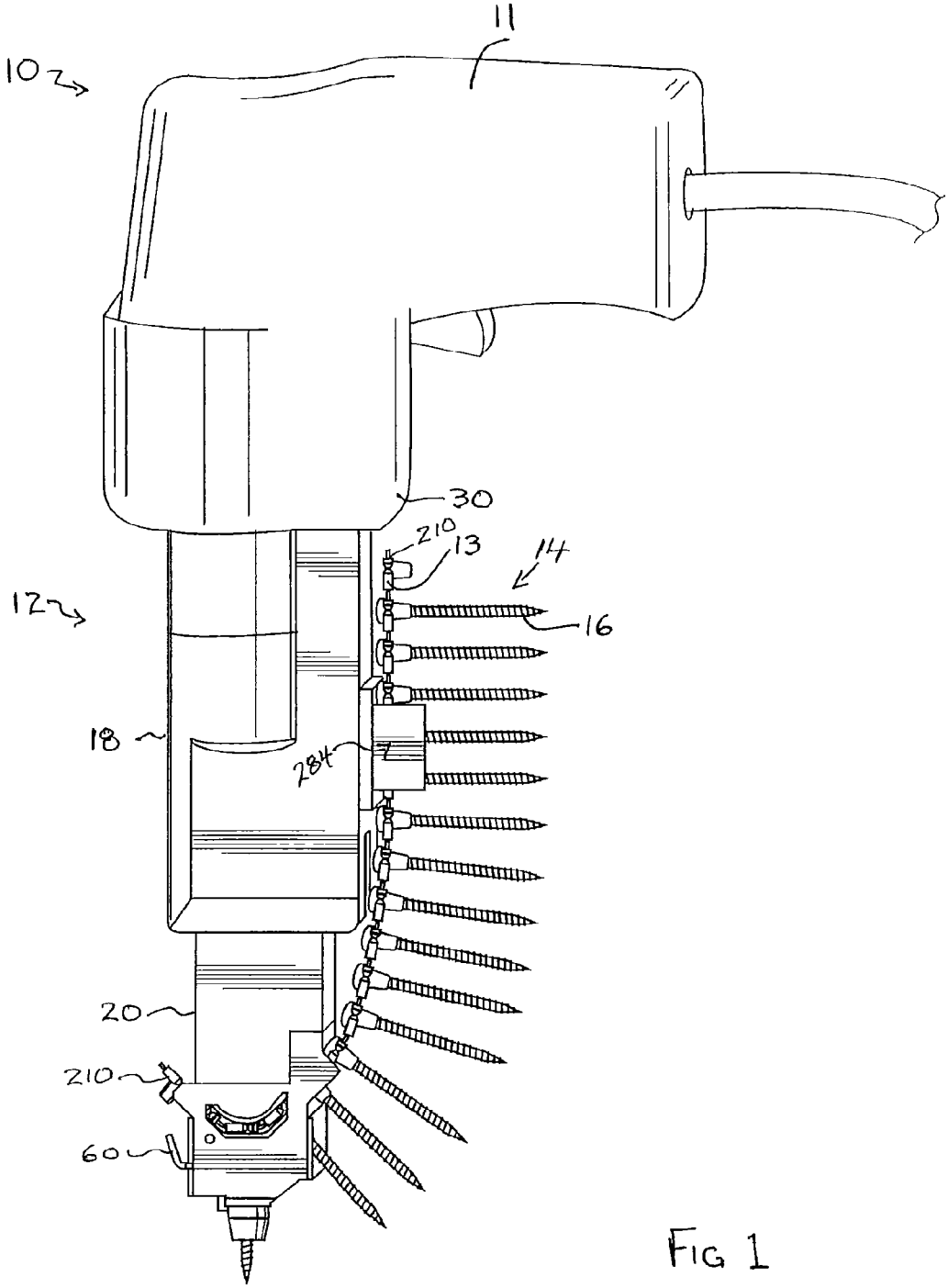
FIG. 1 is a pictorial view of a power screwdriver assembly including an autofeed screwdriving tool in accordance with a first embodiment of the present technology showing notably a first side of the tool.

Reference is made to FIG. 1 which shows a complete power screwdriver assembly 10 in accordance with the present invention. The assembly 10 comprises a power driver 11 to which an autofeed screwdriver tool 12 is secured. The tool 12 is shown as carrying a collated screwstrip 14 having a strap 13 carrying spaced screws 16 to be successively driven.

Figure 2:
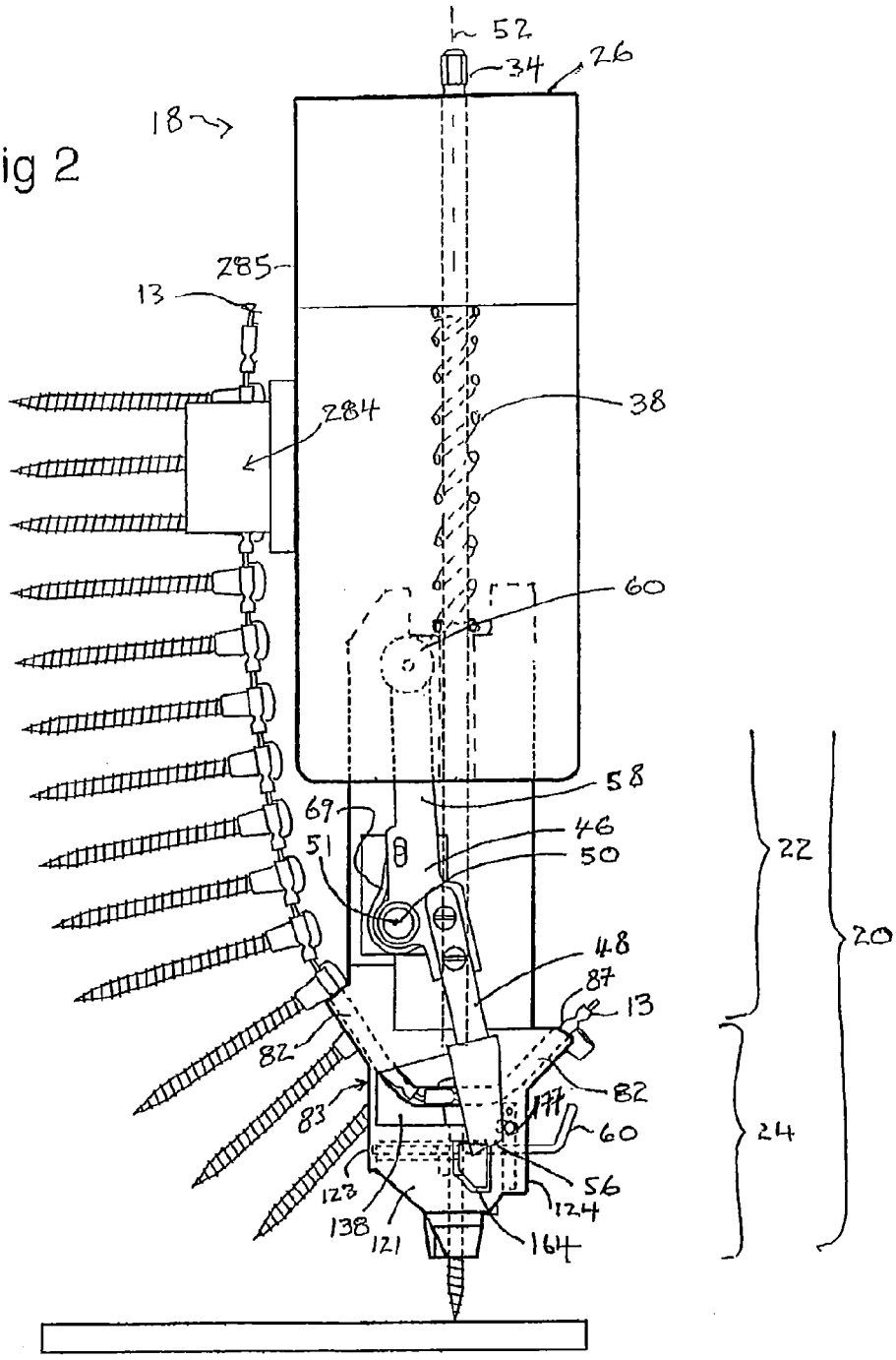
FIG. 2 is a side view of the tool shown in FIG. 1 in a ready position.

Referring to FIGS. 1 and 2, the major components of the tool 12 are a housing 18 and a slide body 20. The slide body 20 comprises a rear portion 22 and a forward nose portion 24.

Figure 10:
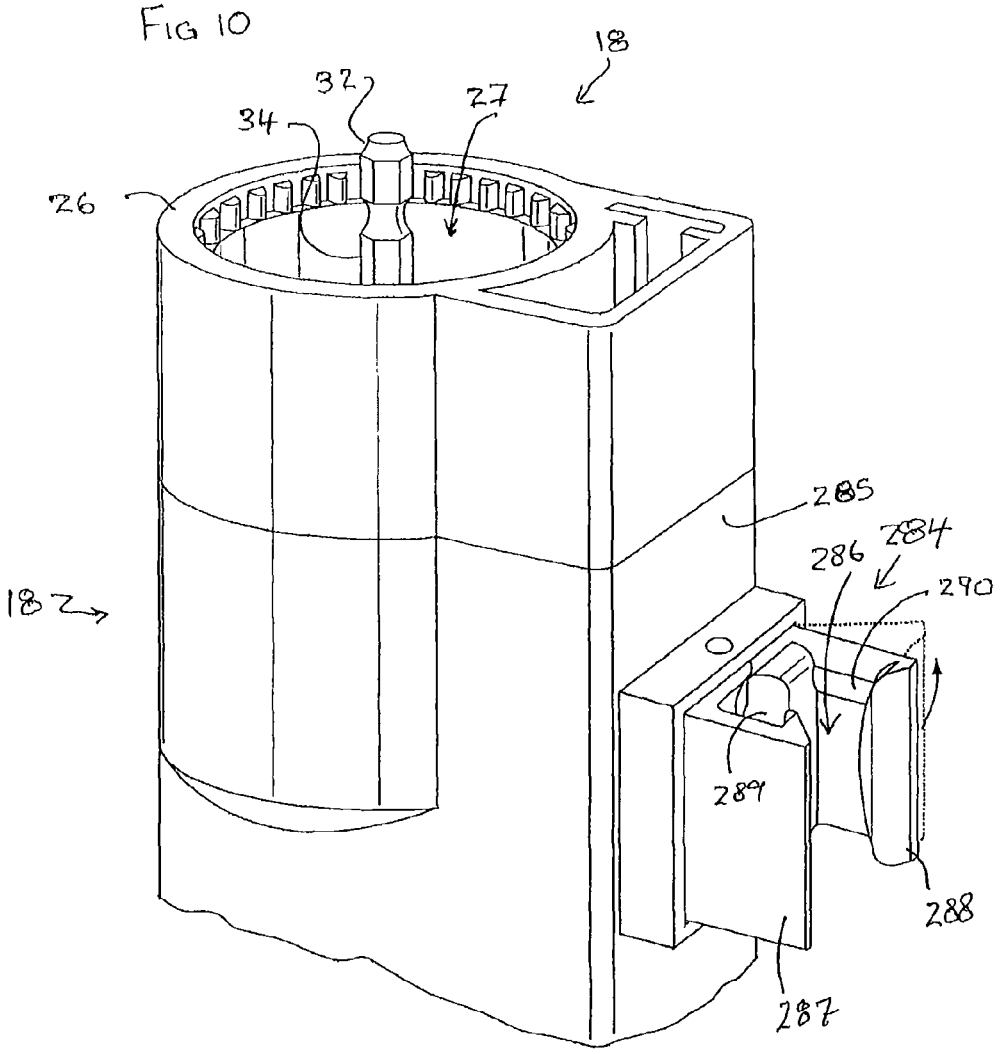
FIG. 10 schematically illustrates a rear portion of the housing of the tool shown in FIG. 2 to illustrate a socket for coupling of the tool to a power driver and a strap slideway on the housing for releasably engaging the screwstrip.

As seen in FIG. 10, the rearmost end 26 of the housing 18 has a rearwardly directed socket 27 to receive and securely clamp the housing 18 onto a housing 30 of the power driver 11 so as to secure the housing 18 of the tool 12 to the housing 30 of the power driver 11 against relative movement. The power driver 11 in a known manner has a chuck (not shown) rotatable relative to the driver housing 30 preferably by an electric motor (not shown). The chuck releasably engages the rear end 32 of a driver shaft 34 in a known manner to couple the driver shaft 34 to the motor for rotation.

Figure 11:
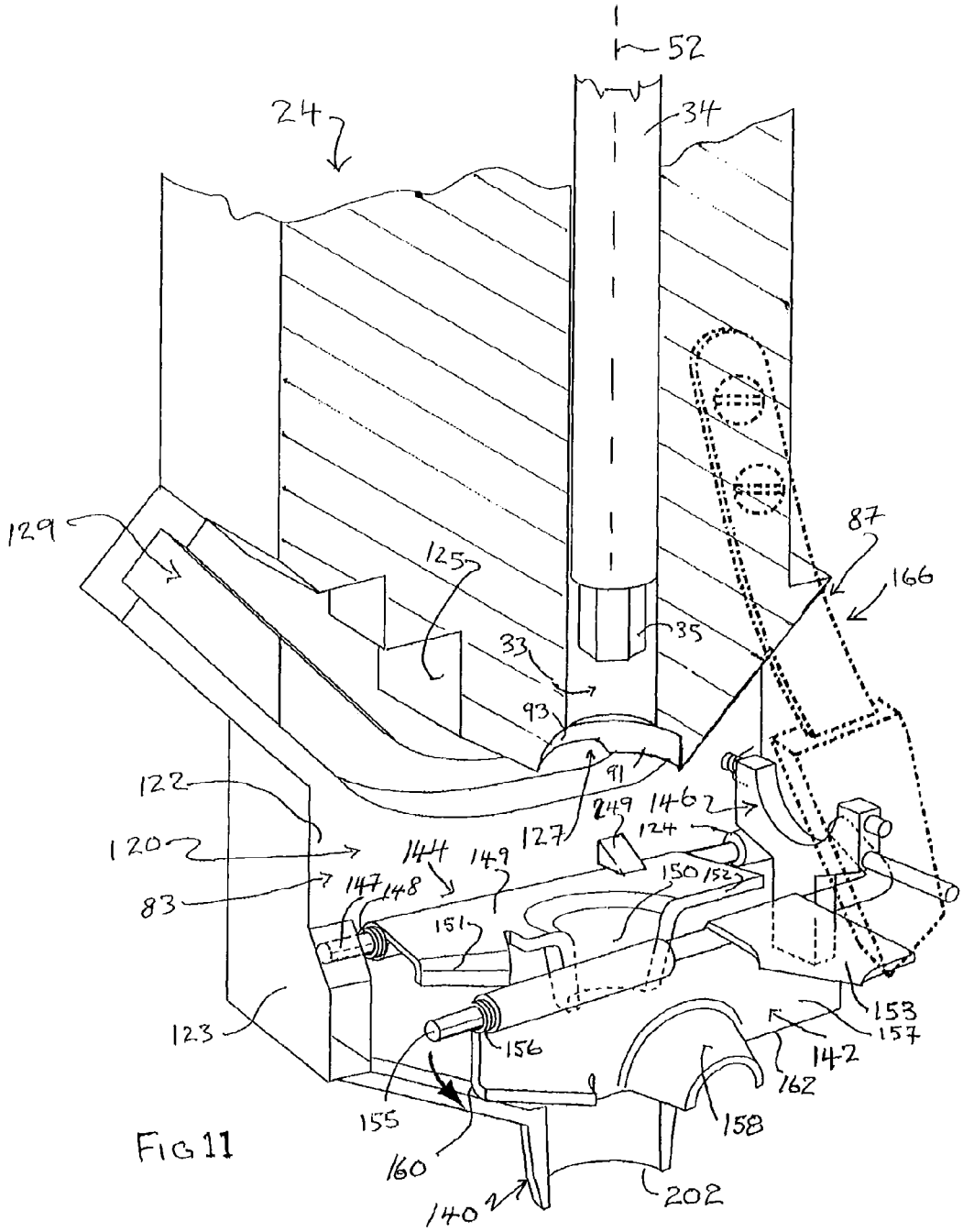
Figure 12:
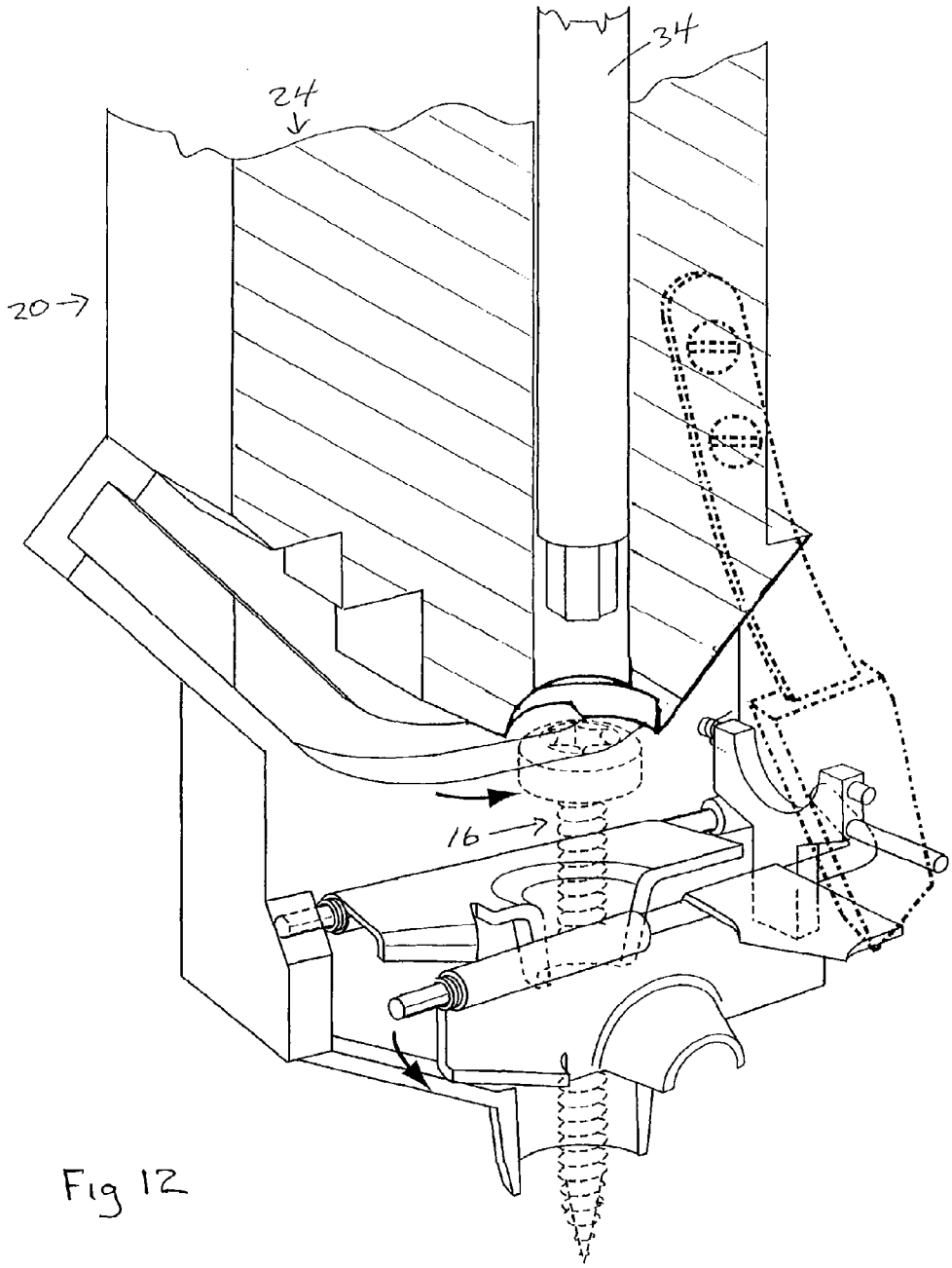

The slide body 20 is slidably received in the housing 18 with the driver shaft 34 received in a bore 33 extending through the slide body 20 as seen in cross-section in FIG. 11. A compression spring 38 schematically shown in FIG. 2 is disposed between the housing 18 and the rear portion 22 of the slide body 20 coaxially about the driver shaft 34 to bias the slide body 20 forwardly away from the housing 18 from a retracted position towards an extended position. In a known manner, the slide body 20 is slidably received in the housing 18 for sliding of the slide body 20 relative the housing coaxially about an axis 52 coaxial with the driver shaft 34. In a known manner, interacting slide surfaces are provided between the housing 18 and the slide body 20 to guide the slide body 20 in sliding parallel the axis 52 relative to the housing. In a known manner, the slide body 20 is slidably engaged within the housing 18 against relative rotation.

As is known, a mechanism is provided to prevent the slide body 20 from being moved forwardly out of the housing 18 past a fully extended position shown in FIG. 2.

Figure 6:
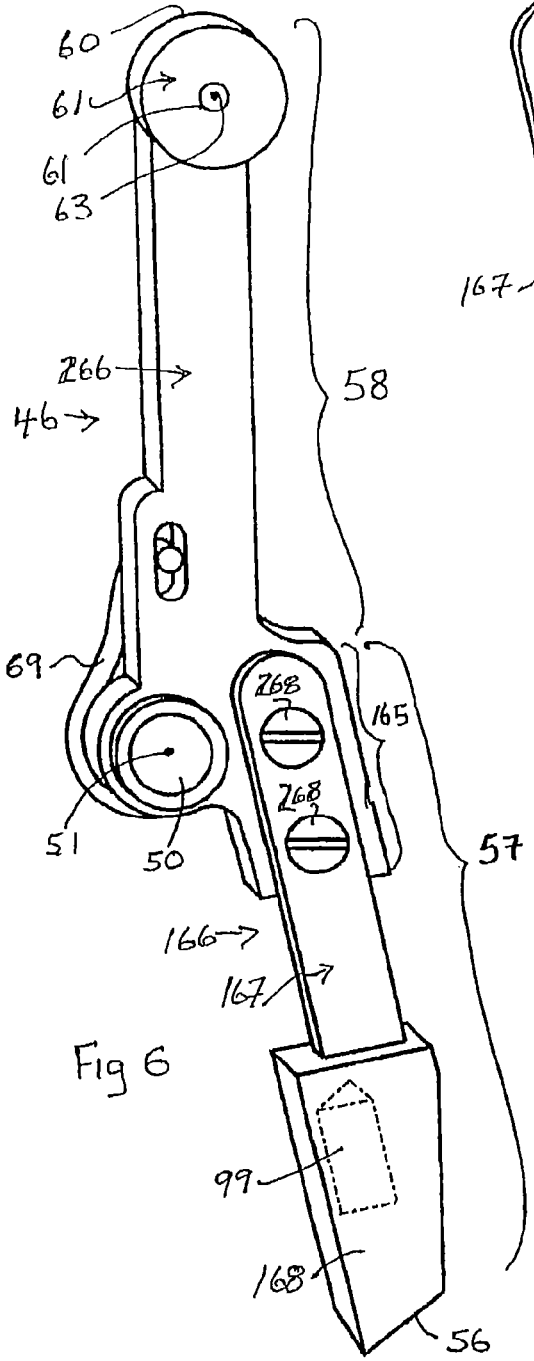
FIG. 6 is a pictorial view of an advance lever shown as an element of the nosepiece of the tool from the side shown in FIG. 2.

An advance lever 46 is pivotally mounted to the rear portion 22 of the slide body 20 by an axle-forming bolt 50 for pivoting about an axis 51 of the bolt 50 normal to the longitudinal axis 52 which passes coaxially through the driver shaft 34 and about which the driver shaft 34 is rotatable. As best seen in FIG. 6, the advance lever 46 has a forward arm 57 extending forwardly to its forward end 56 and a rear arm 58 extending rearwardly to its rear end 60. A cam roller 61 is mounted to the rear arm 58 proximate its rear end 60 on a pin axle 61 for rotation about an axis 63 normal to the axis 52 of the driver shaft 34.

Figure 22:
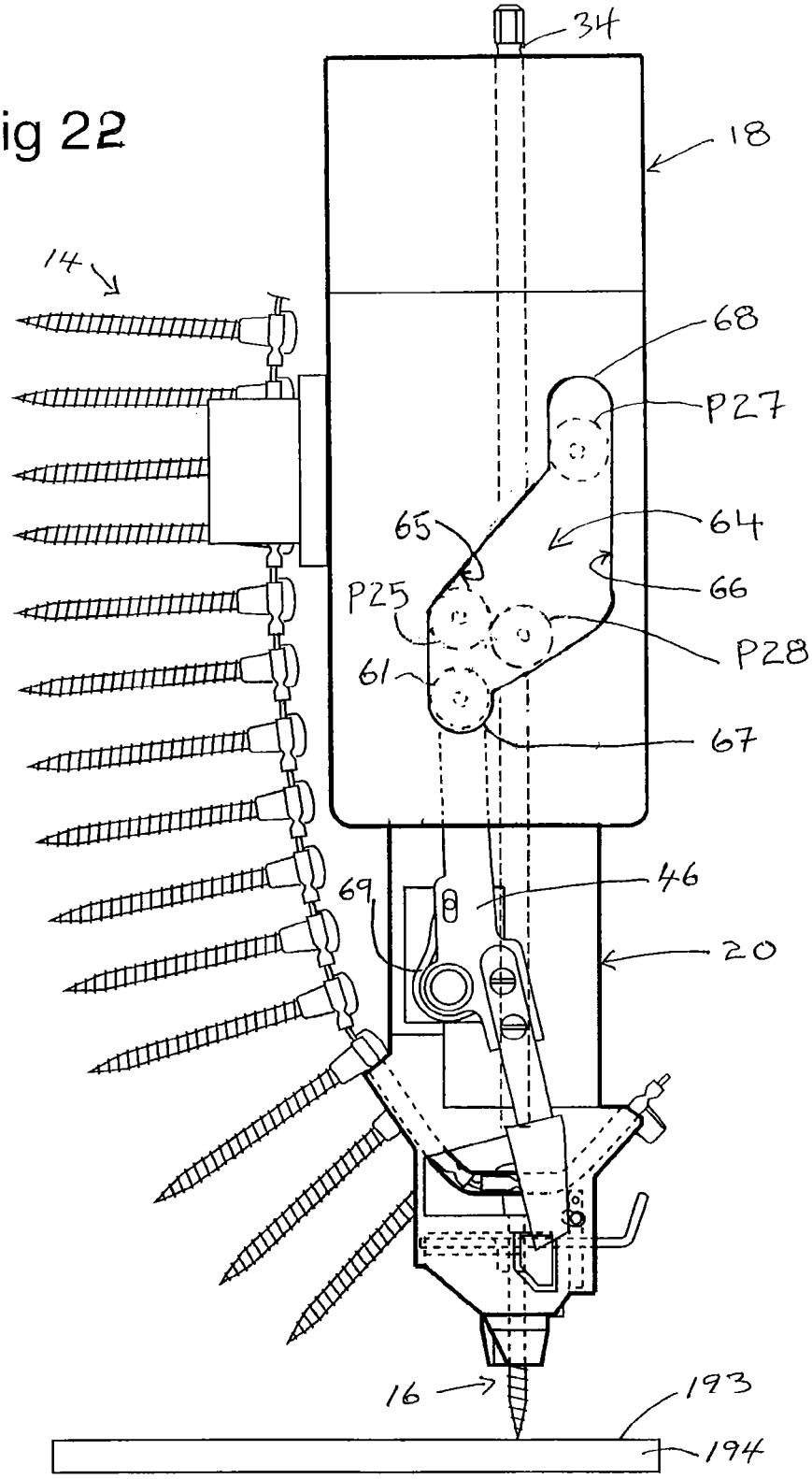
FIGS. 22 to 29 illustrate the tool shown in FIG. 1 in side views similar to that shown in FIG. 2 but in sequential positions in the driving of a screw into a workpiece successively from the position of FIG. 22 with the first screw in a ready position to a position of FIG. 29 in which the first screw is fully driven into a workpiece and the next successive screw from the screwstrip is in a ready position.

In a known manner, the cam roller 61 is engaged within a cam slot 64 provided in the housing 18 as shown schematically in solid lines in FIG. 22. The cam slot 64 has a first camming surface 65 and a second camming surface 66 spaced therefrom and presenting different profiles as schematically shown in FIG. 22. The cam roller 61 is received in the cam slot 64 between the first camming surface 65 and the second camming surface 66 for engagement of each under different conditions of operations in a manner as is known and is taught, for example, in the above-noted U.S. Pat. No. 6,453,780. A spring 69 about the bolt 50 disposed between the rear arm 58 and the nose portion 22 biases the lever 46 to pivot about the bolt 50 in a counter-clockwise direction as seen in FIG. 22 and thus biases the advance lever 46 to pivot in a direction which moves its forward end 56 towards the right and biases the cam roller 61 towards the first camming surface 65. In a known manner, with relative sliding of the slide body 20 and the housing 18 between extended and retracted positions, the cam roller 61 translates the relative movement and positioning of the slide body 20 in the housing 18 into relative pivoting and positioning of the advance lever 46 about the axis 51.

Figure 3:
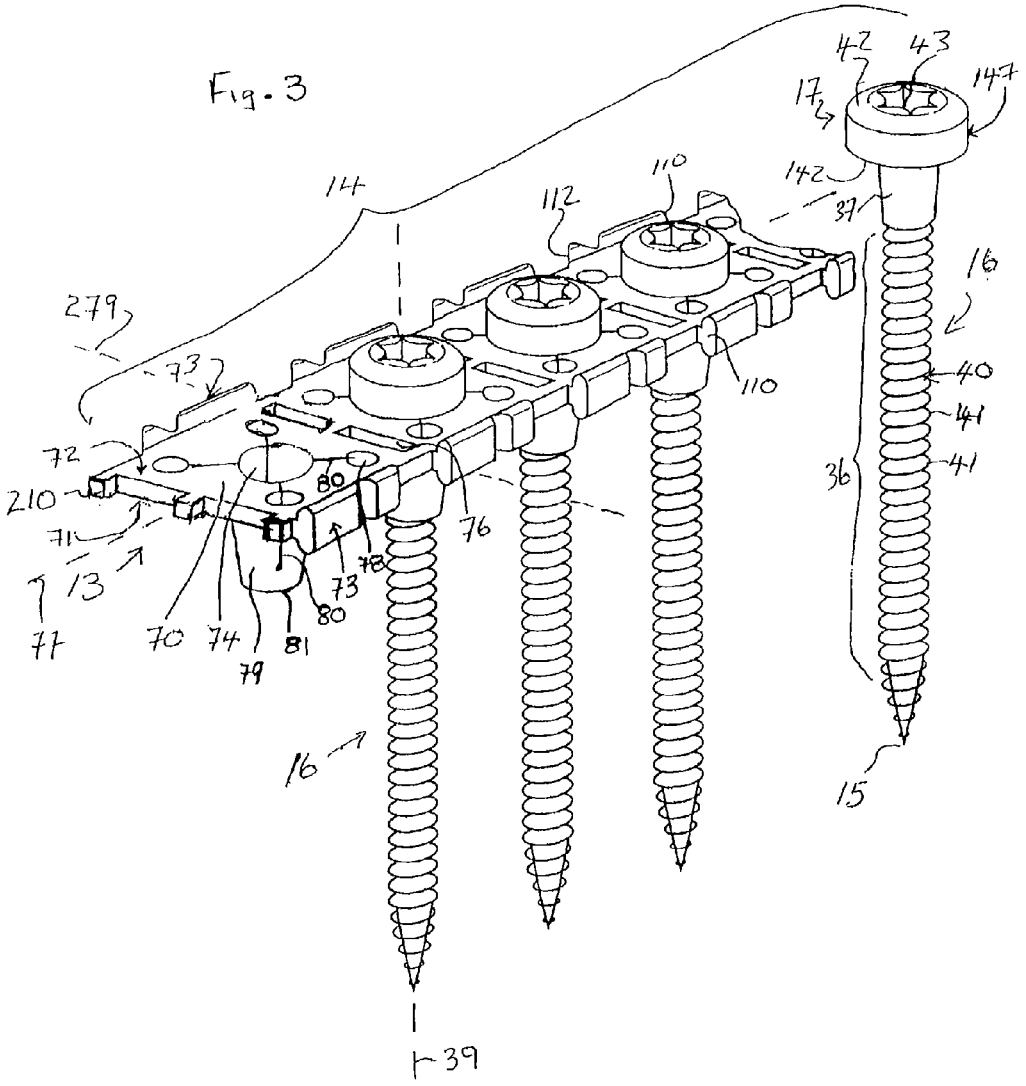
FIG. 3 is a pictorial view of a segment of the screwstrip used in the tool of FIG. 1.
Figure 4:
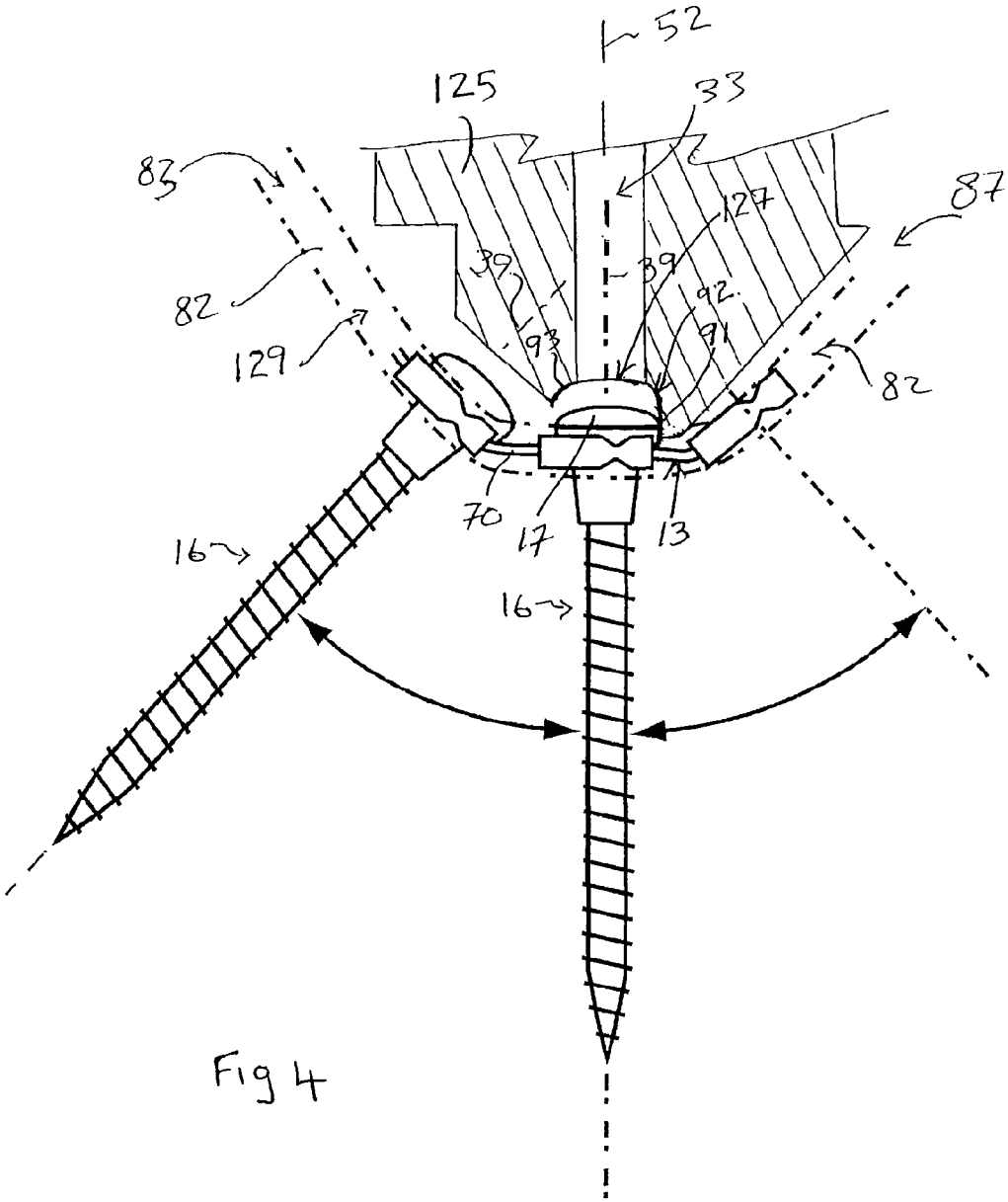
FIG. 4 is a schematic enlarged side view of the tool in FIG. 2 schematically illustrating a portion of the screwstrip engaged within a strap feed guideway.

Reference is made to FIGS. 3 and 4 which illustrate a flat tape screwstrip 14 shown in FIG. 2 for use with the tool 12. The screwstrip 14 comprises a retaining strip 13 and a plurality of screws 16. In FIG. 3, one end of the screwstrip 14 is shown with one screw 16 shown separated from the screwstrip. The retaining strip 13 is preferably formed from a plastic material. The retaining strip 13 comprises a central web 70 of relatively uniform thickness between a rear surface 71 of the web 70 and a forward surface 72. The web 70 carries at each of its sides, flange members 73 which extend forwardly and rearwardly a greater extent than the rear surface 71 and the forward surface 72 such that as seen in a longitudinal end view the web 70 would appear to have a generally H shape. Rectangular openings 76 extend through the web 70 transverse to a longitudinal 77 through the strap 13 with the rectangular openings 76 effectively serving to divide the web 70 into a series of segments 75. These rectangular openings 76 are provided at each end of each segment 75 at a location where the flange members 73 are not provided on the web 70 and the rectangular openings 76 so as to enhance the ability of the strap 13 to be flexible and bend between segments 75 as along notional hinge axes 279 perpendicular to longitudinal 77 through each pair of the rectangular openings 76 to assist the strap 13 to generally adopt a curved shape as illustrated in FIG. 4 as constrained by a guideway 82 while maintaining an axis 39 extending centrally through each of the screws 16 to be disposed in a common flat plane including the longitudinal with the axis 39 of the various screws disposed at an angle to each other.

Figure 9:
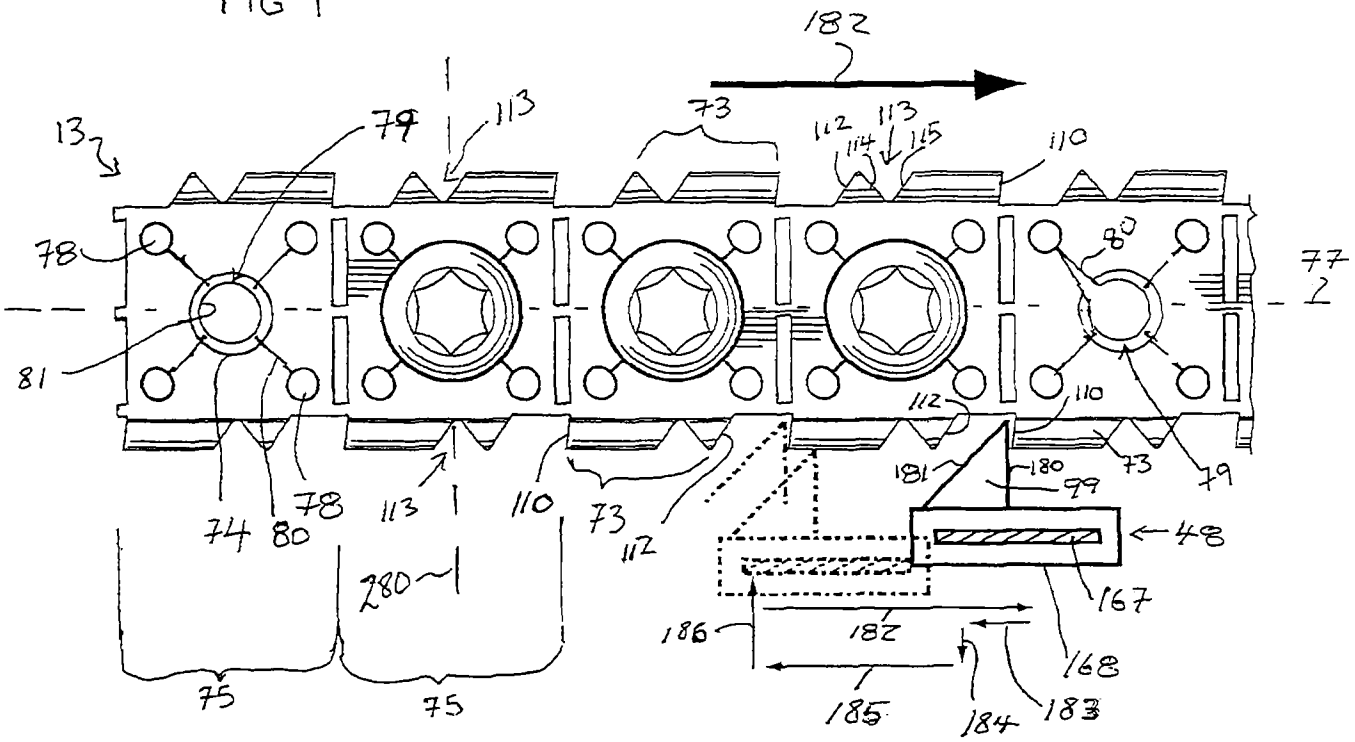
FIG. 9 is a schematic view looking downwardly on a screwstrip as illustrated in FIG. 3 to schematically illustrate the manner in which the forward portion of the advance lever shown in FIGS. 6 to 8 advances the screwstrip in a schematic sequence of operation of the tool.

FIGS. 3 and 9 show at the left-hand end of each screwstrip 14 a segment 75 in which a screw is not provided. Each segment 75 has a central opening 74 through its web 70 adapted to engage about a shank 40 of a screw 16. The web 70 carries a sleeve 79 which extends forwardly from the forward surface 72 about the center opening 74 and sized to closely receive an upper portion 37 of the shank 40 of a screw 16. The web 70 has four corner openings 78. A slit 80 extends from each corner opening 78 radially towards a center of the central opening 74 with the slit preferably extending entirely between the forward surface 71 and the rear surface 72 of the web and into the sleeve 79, however, with the slit 80 ending rearward of a forward end 81 of the sleeve 79. FIG. 9 shows at the right hand end a segment 75 from which a screw has been driven, schematically showing the sleeve 79 as ruptured at the forward end of one slot 80 in the upper left hand quadrant of the segment 75 in the driving of a screw forwardly through the sleeve 79.

As seen in FIGS. 3 and 9, each flange member 73 has a flange catch surface 110 which is disposed in a plane approximately normal to the longitudinal 77 of the strap 13 and a flange cam surface 112 disposed in a plane at an angle to the longitudinal 77. Each flange member 73 also has a center notch 113 which is formed between a first cam shoulder 114 and a second cam shoulder 115. The notch 113 of the flange 73 on one side of the strap 13 and the notch 113 of the flange member 73 on the other side of the strap 13 are aligned such that a plane 280 joining the two located in the apex of each notch 113 is disposed substantially to longitudinal 77 centrally through the sleeve 79.

As schematically illustrated in FIG. 9, the flange catch surface 110 is adapted to be engaged by a pawl 99 carried at the forward end 56 of the forward arm 48 of the advance lever 46 to advance a screwstrip 14 to the right in use of the tool and with the flange cam surface 112 as well as the first cam shoulder 114 and second cam shoulder 115 permitting the pawl 99 to slide to the left as seen in FIG. 9 from engagement with one flange catch surface 110 of one segment 75 over the laterally outward surfaces of the flange member 73 to a position where the pawl 99 may engage the next flange catch surface 110 of the next segment 75 of the strap 13.

Figure 5:
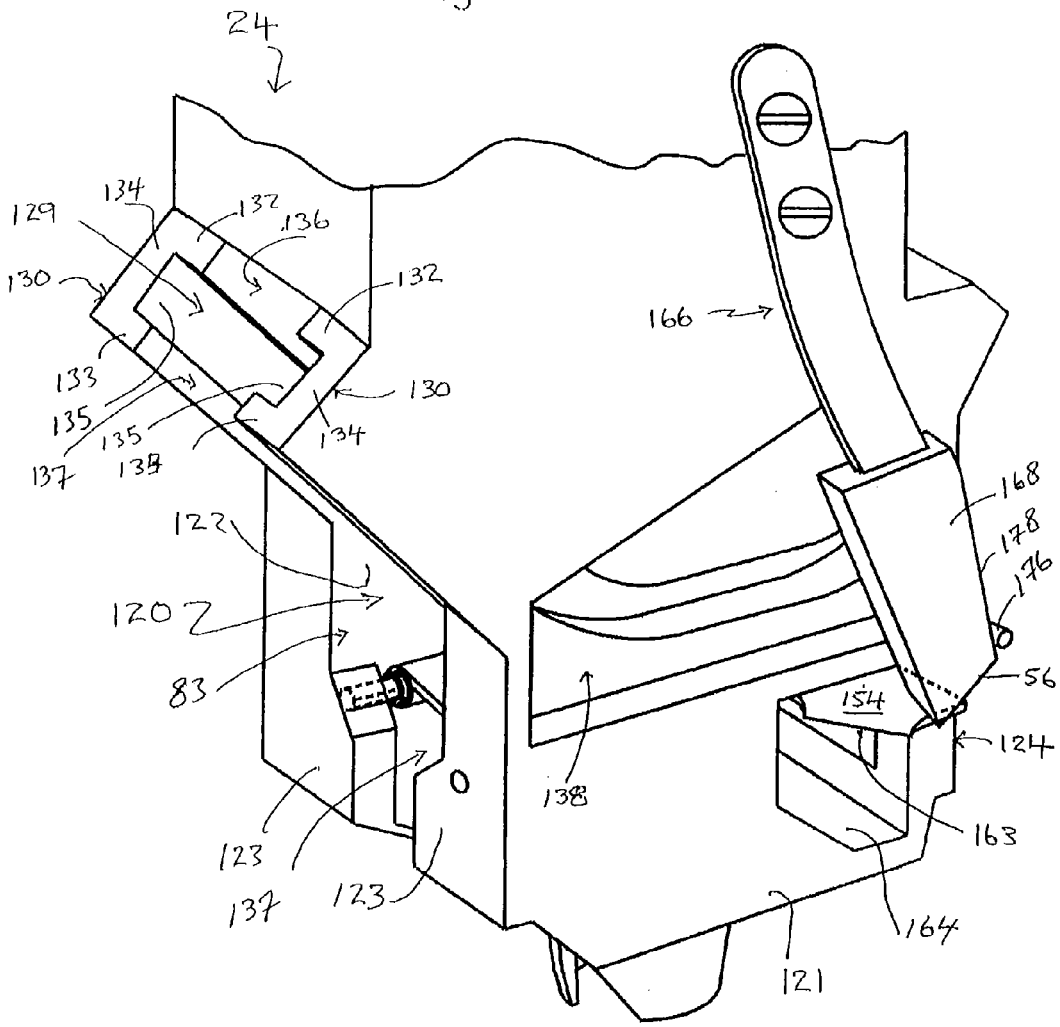
FIG. 5 is a pictorial view of a forwardmost portion of a slide body of the tool shown in FIG. 2 without the screwstrip and with a first guide member in an open position to permit manual advancement or withdrawal of a screwstrip.

Reference is made to FIGS. 5 and 11 to describe the configuration of the forward nose portion 24 of the slide body 20. In FIGS. 5 and 11, the nose portion 24 is shown in a fully extended position the same as that as in FIG. 2, however, for ease of convenience with merely a forward portion 166 of the forward arm 48 of the advance lever 46 shown and not the remainder of the advance lever 46.

Reference is made to FIG. 2 which illustrates a screwstrip 14 as engaged with the tool 12. In this regard, as schematically illustrated in broken lines in FIG. 2, the guideway 82 is provided through the nose portion 24 through which the screwstrip 14 passes with the guideway 82 having an exit opening 87 from which the strap 13 is shown to extend as a segment 75 of the strap 13 from which its screw has been removed.

The nose portion 24 defines a screw guide chamber 120 therein between a first side wall 121, a second side wall 122 opposite the first side wall 121, an entrance side wall 123 and an exit side wall 124 opposite the entrance side wall 121. The screw guide chamber 120 has a rear wall 125 through which the bore 33 for the driver shaft 34 extends. The bore 33 opens into a downwardly directed generally concave screw head engaging socket 127 with as seen in FIG. 4 a forwardly directed surface over an annular drive portion 93 of an interior surface 92 of the socket 127. The screwstrip guideway 82 has an entranceway 83 on the left-hand side of the nose portion 24 as seen in FIGS. 2, 5 and 11 to permit the screwstrip 14 including both its strap 13 and its screws 16 to enter the screw guide chamber 120 but with the exit opening 87 of the guideway 82 on the left-hand side to merely permit exit of the strap 13. The guideway 82 is schematically shown in side view in FIG. 4 and, in a similar schematic manner, is shown in FIG. 2. The guideway 82 extends in a generally U-shape through the screw guide chamber 120 to guide the strap 13 from the entranceway 83 to the exit opening 87. The guideway 82 includes a strap feed channelway 129 adapted to capture the strap 13 therein. The strap feed channelway 129 is defined between two C-shaped channel forming members 130. Each channel facing member 130 has a pair of laterally inwardly extending rear arms 132 and forward arms 133 extending laterally inwardly from a bridging back plate 134 so as to define a bight 135 sized to closely receive the flange members 73 of the strap 13 therein. Between the rear arms 132, a head channel 136 is provided as part of the feed strap channelway 129 sized to receive the head 17 of each screw and let the head 17 pass freely through the feed strap channelway 129. Between the forwardmost arms 133, a channel 137 is provided which extends forwardly through the entrance side wall 123 and towards the right as seen in FIG. 5 and forming a forward portion of the guideway 82 that extends between the first side wall 121 and the second side wall 122 towards the exit side wall 124 but not through the exit side wall 124.

As seen in FIGS. 2 and 5, the first side wall 121 has a recess 138 removed therefrom open to an outer surface 138 of the first side wall 121. The recess 138 extends inwardly through the back plate 134 and into the front arm 132 and the rear arm 133 leaving but a thin laterally inwardmost portion of each of the arms 132 and 133 to assist in guiding the strap 13 through the strap feed channelway 129. The recess 137 provides access for the pawl 99 on the forward portion 166 of the forward arm 48 of the advance lever 46 to extend laterally into the strap feed guideway 129 to engage the strap 13 and notably the catch surfaces 110 on the flange members 73 of the strap 13 to permit the screwstrip 14 to be advanced through the guideway 82 by engagement with the pawl 99.

As seen in the partially cross-sectional view of FIG. 11, the second side wall 122 carries a touch down foot 140 in the form of a vertically truncated tubular member disposed to one side of the guideway 82 so as to not impede sliding of the shank 40 of each successive screw 16 along the guideway 82 to a ready position axially in line with the driver shaft 34.

As seen in FIG. 3, each screw 16 extends along the screw axis 39 from its head 17 to its tip 15. The head 17 has rearwardly directed rear upper surface 42. A recess 43 extends forwardly into the head 17 through the upper surface 42 and is shown to have a generally hexagonal shape disposed coaxially about the screw axis 39. The recess 43 extends into the head to a blind end (not shown). The head 17 is shown to have a forwardly directed forward shoulder 142 which is disposed in a plane normal to the screw axis 39. Each screw has the shank 40 which is threaded by threads 41 over a lower portion 36 of the shank 40 to an unthreaded upper portion 37 of the shank, which upper portion 37 is generally enlarged compared to the remainder of the shank and preferably frustoconical as shown. The upper portion 37 merges into the head 17.

The bit 35 carried on the forward end of the driver shaft 34 is sized to become engaged within the recess 43 in the head of the screw to rotate the screw and urge the screw forwardly by transfer of axially directed forces from the driver shaft 34 to the screw 16.

Figure 17:
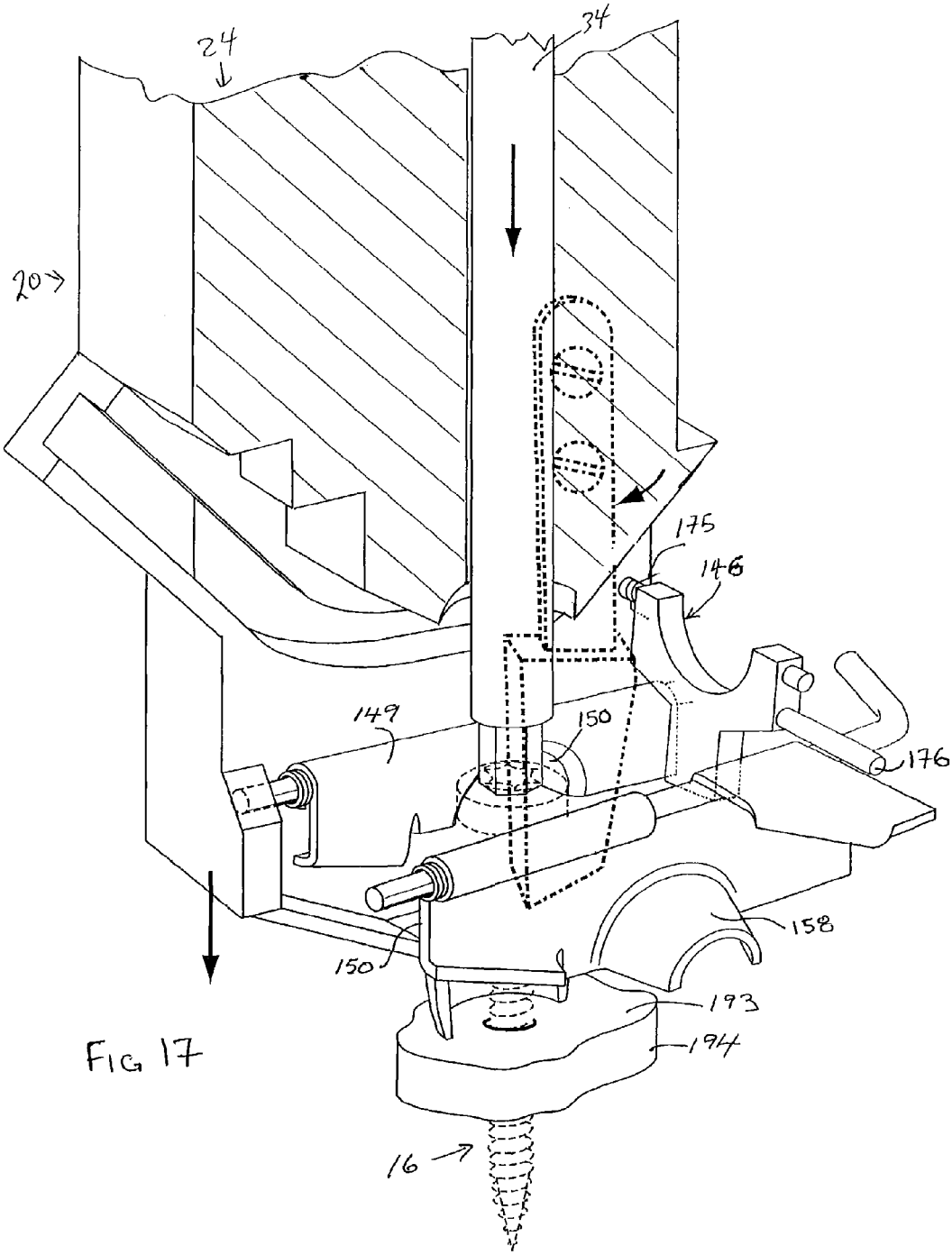

Reference is made to FIG. 11 which shows in partial vertical cross-section the interior of the screw guide chamber 120 and notably the provision therein of a first guide member 142, a second guide member 144 and a spreader member 146. The second guide member 144 has an axle member 147 secured thereto with one end of the axle member journalled in a bore in the entrance side wall 123 and the other end of the axle member 147 journalled in the exit side wall 124 only schematically shown such that the axle member 147 may pivot relative the nose portion 24 about an axis coaxially through the axle member 147 and normal the axis 52. The second guide member 144 is rotatable from a closed position as shown in FIG. 11 to an open position as shown in FIG. 17. A coil spring 148 is disposed about the axle member 147 between the second guide member 144 and the second side wall 122 so as to bias the second guide member 144 to rotate to the closed position shown in FIG. 11. The second guide member 144 may be deflected to rotate with the axle member 147 against the bias of the coil spring 148, however, with the coil spring 148 inherently biasing the second guide member 144 to return to the closed position of FIG. 11. FIG. 11 shows a stop member 249 carried on the inside surface of the second side wall 122 rearward of the second guide member 174 to engage the second guide member 144 and prevent it from rotating rearwardly beyond the open position. While not shown in the drawings, another stop member is also provided on the second side wall 122 to prevent rotation of the second guide member 144 beyond the open position shown in FIG. 17. The second guide member 144 includes a plate portion 149 having a rear surface disposed substantially in a flat plane and from which a frustoconical half guide tube 150 extends. On the left-hand side of the half guide tube 150, the plate portion 149 carries a screw shaft camming surface 151 which, as seen in FIG. 11, extends laterally outwardly towards the second side wall 122 as it extends towards the entrance side wall 123. To the right of the half guide tube 150, the plate portion 149 has a stop surface 152 directed laterally away from the second side wall 122.

Figure 13:
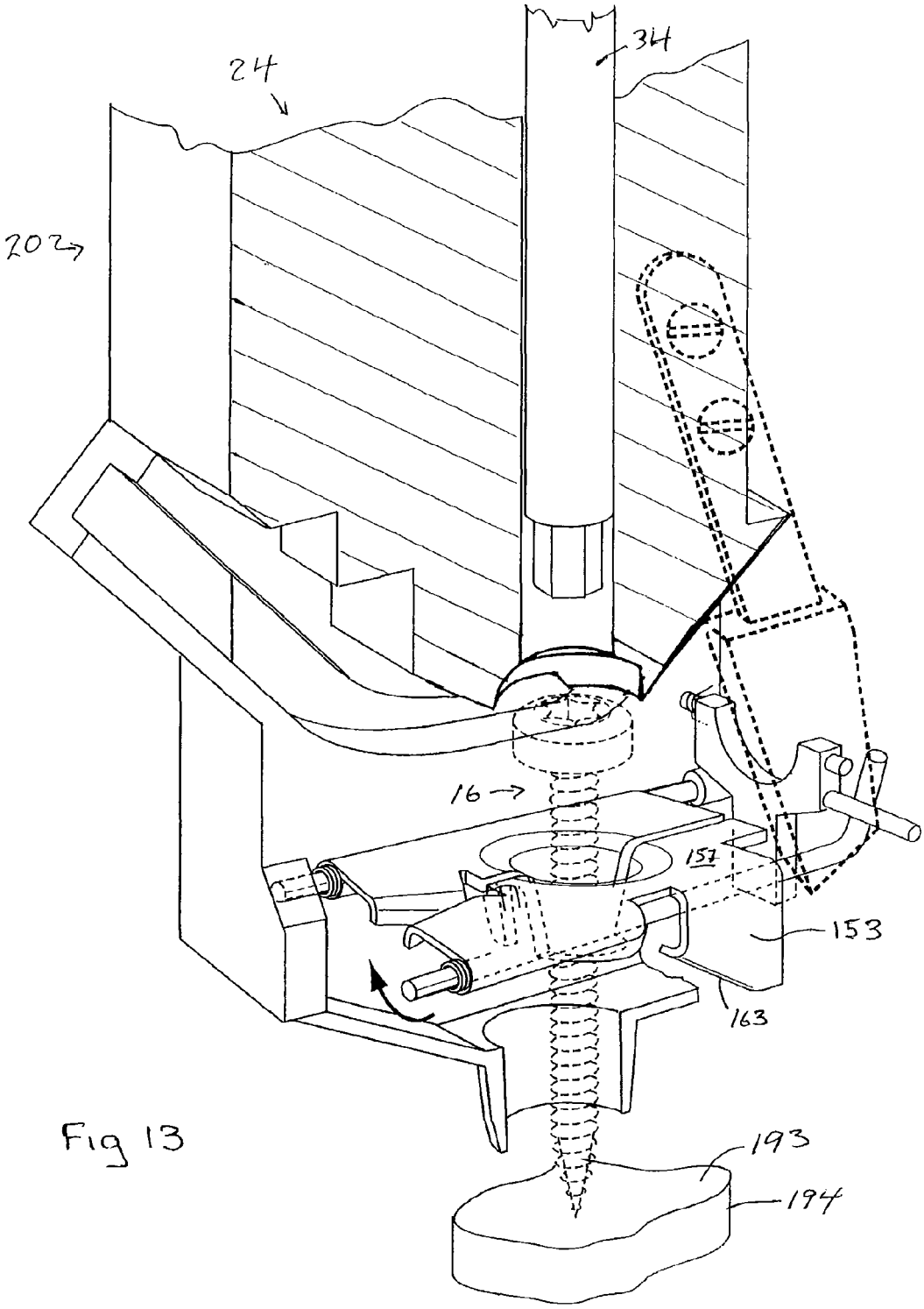

The first guide member 142 is substantially a mirror image of the second guide member with the exception of the inclusion of a cam arm 153. In this regard, as seen in FIG. 11, the first guide member 142 includes an axle member 155 extending parallel to the axle member 147. The axle member 155 has one end journalled in a bore in the entrance side wall 123 and the other end journalled in a bore in the exit side wall 124 such that the axle member 155 may pivot relative the nose portion 24 about an axis coaxially through the axle member 155. A coil spring 156 is disposed about the axle member 155 between the first guide member 142 and the first side wall 121 so as to bias the first guide member 142 to rotate to a closed position as, for example, illustrated in FIG. 13. The first guide member 142 may be pivoted with the axle member 155 from the closed position as shown in FIG. 13 to an open position as shown in FIG. 11 against the bias of the coil spring 156. Suitable stop members similar to the stop member 149 are provided in respect of the first guide member 142, while not shown, to limit rotation of the first guide member 142 between the open position and the closed position.

The axle member 155 for the first guide member 142 is formed from a cylindrical rod which after extending outward through a journaling bore in the exit side wall 124 is bent to extend radially at an angle to an axis of the rod so as to form a radially extending axle extension lever 60 easily seen in FIGS. 1 and 2. The axle extension lever 60 is accessible outside of the slide body 20 for manual engagement as by a finger (not shown) of a user of the tool 12 so as to manually move the first guide member 142 to the open position as shown in FIG. 11 and hold it in the open position for manual insertion and withdrawal of a screwstrip 14 from the tool 12.

The first guide member 142 has a plate portion 157 with a half guide tube 158, a screw shaft camming surface 169 and a stop surface 162 which are substantially mirror images of the same elements provided on the second guide member 144. The first guide member 142 also carries the cam arm 154 which, as seen in the closed position as in FIG. 13, extends forwardly in a plane at right angles to a plane of the plate portion 157 and presents an angled pawl arm camming surface 163. As seen in FIGS. 2 and 5, the first side wall 121 has an opening 164 therethrough into the screw guide chamber 120 laterally in line with the cam arm 154. On rotation of the first guide member 142 from the closed position shown in FIGS. 2 and 13 to the open position shown in FIGS. 5 and 11, the cam arm 154 moves from an orientation extending forwardly from the plate portion 157 to an orientation extending laterally from the plate portion 157 and through the opening 164 as shown in FIG. 11. When the tool is in the fully extended position, in moving from the closed position of FIGS. 2 and 13 to the open position of FIGS. 5 and 11, the camming surface 163 on the cam arm 154 engages the forward end 56 of the forward portion 166 of the forward arm 48 of the advance lever 46 deflecting the forward end 56 laterally outwardly away from the first side wall 121 sufficiently that the pawl 99 carried on the forward arm 54 is displaced laterally beyond engagement with the flange members 73 on any strap 13 received within the strap feed channelway 129 as best seen in FIGS. 5 and 11.

Figure 8:
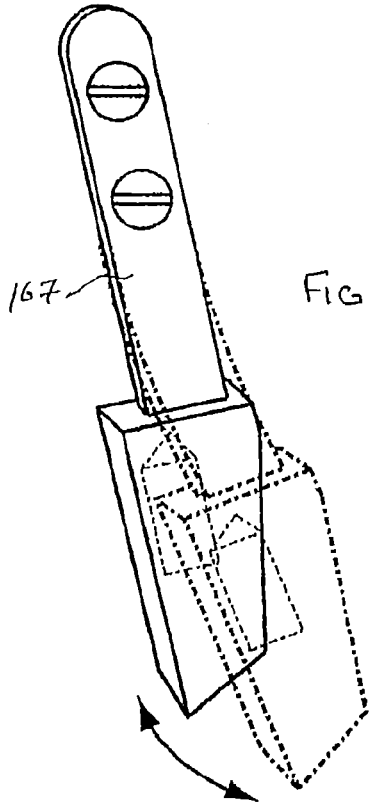
FIG. 8 is a schematic pictorial view of a forward resilient portion of the advance lever of FIG. 6 illustrating its resiliency.

Reference is made to FIG. 6 which is a pictorial view of the advance lever 46 and showing that the rear arm 58 and a rear portion 165 of the forward arm 48 are formed from a inflexible rigid plate 266. A forward portion 166 of the forward arm 48 comprises an elongate resilient plate 167 which is fixedly secured by two screws 268 to the rigid plate 266 and with the resilient plate 167 carrying at its end a camming paddle 168 carrying the pawl 99 and, as well, a camming surface 169 adapted for engagement with the camming surface 163 of the cam arm 164 to assist in lateral deflection of the forward end 56 of the forward arm 48. The resilient plate 167 preferably comprises an elongate planar sheet of a resilient metal which is adapted to deflect in a direction normal to its plane and thus laterally of the slide body. FIG. 8 schematically illustrates the inherent resiliency of the resilient plate 167 from a position which is unbiased in solid lines to a deflected position shown in dashed lines. The resilient plate 167 when deflected laterally to a deflected position has an inherent bias to return to the unbiased position.

Figure 18:
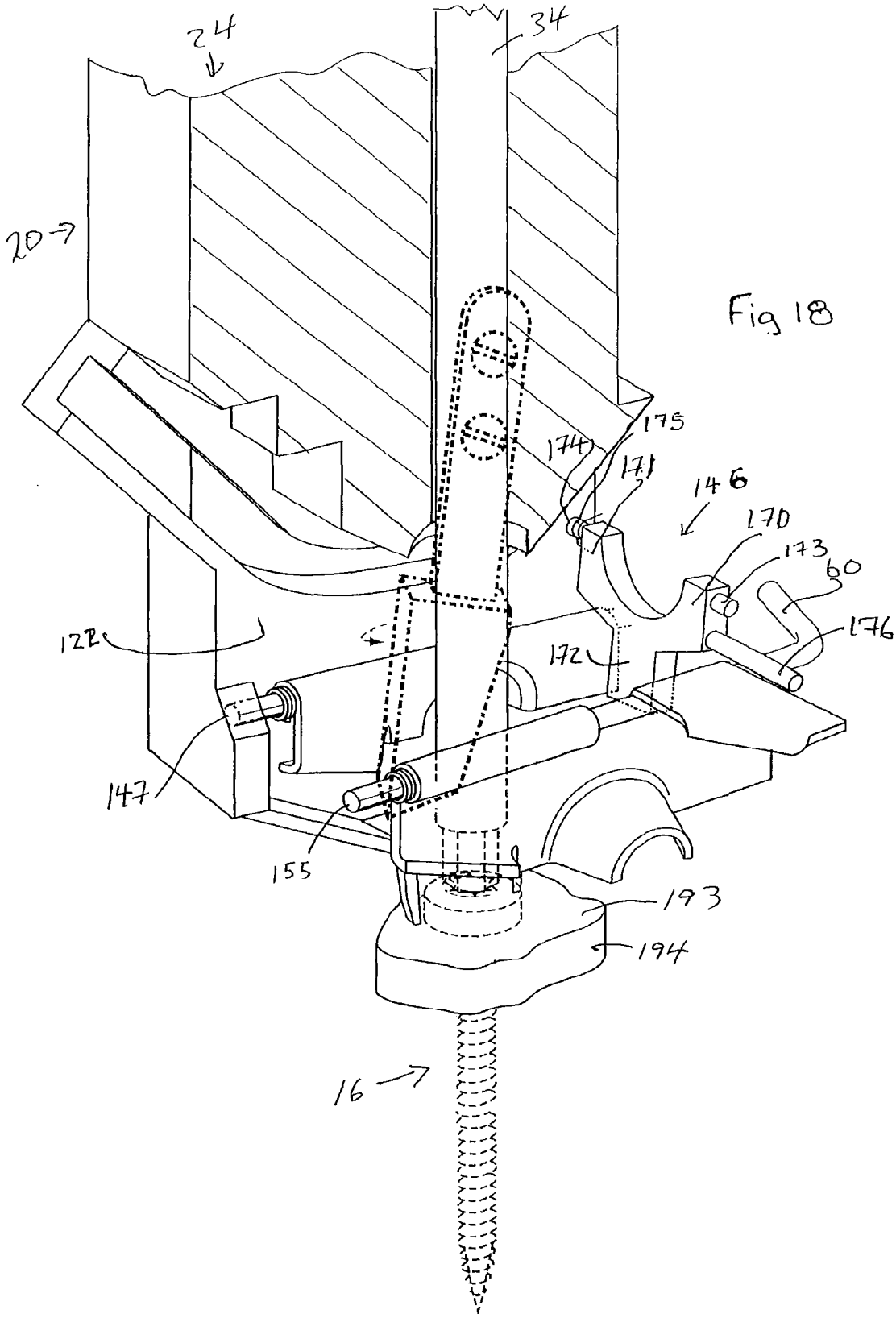
Figure 21:
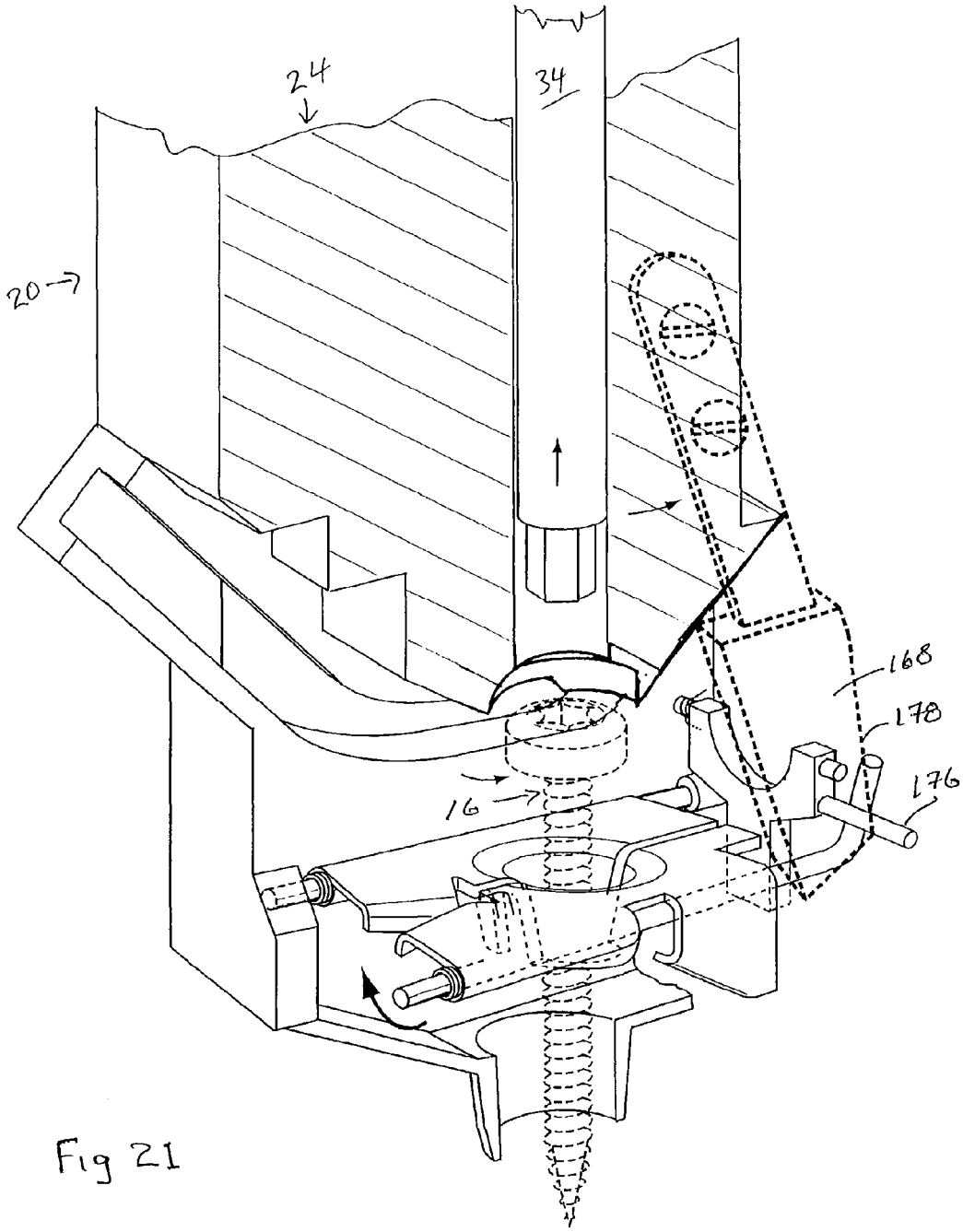

Reference is made to FIG. 18 showing the spreader member 146 as having a general Y shape with a pair of arms 170 and 171 joined to a stop leg 172. The arm 170 carries a stub axle 173 journalled in a bore in the first side wall 121 (not shown in FIG. 18) and the second arm 171 carries a similar stub axle 174 journalled in a bore in the second side wall 122 with the stub axles 173 and 174 coaxial with each other and perpendicular to the axes of each of the axle member 147 and the axle member 155. A coil spring 175 disposed about one stub axle 174 and between the spreader member 146 and the exit side wall 124 (not shown in FIG. 18) biases the spreader member 146 clockwise about the stub axles 173 and 174 as seen in FIG. 18, that is, to urge the stop leg 72 to the left as seen in FIG. 18 towards the first guide member 142 and the second guide member 144. A release pin 176 extends laterally from the arm 170 parallel to the stub axles 173 and 174 and through a slotway 177 in the first side wall 121 to protrude laterally on the outside of the second side wall 122 as seen, for example, in FIG. 2. The slotway 177 is elongate having a first end closer to the entrance side wall 123 than a second end and extending from the first end towards the exit side wall 124. The release pin 176 is received in the slotway 177 with the ends of the slotway 177 limiting movement of the spreader member 146 from an unblocking position as shown in FIG. 11 to a blocking position as shown in FIGS. 17 to 20. The coil spring 175 biases the spreader member 146 to assume the blocking position shown in FIG. 18 and to return to the blocking position if displaced from the blocking position to the unblocking position. The release pin 176 extends laterally from the first side wall 121 at a location that the release pin 176 is engaged by the paddle 168 of the forward portion 166 of the advance lever 46 at desired times during a cycle of movement of the slide body 20 relative to the housing 18 in use of the tool 12 such that, as schematically illustrated, in the paddle 168 moving from a position shown in FIG. 20 to the position shown in FIG. 21, a surface 178 of the paddle 168 engages the release pin 176 to move the release pin 176 in the slotway 177 to the right and thus pivot the spreader member 146 about the stub axles 173 and 174 against the bias of the coil spring 175 to the unblocking position. As seen in FIG. 5, the release pin 176 extends laterally of the first side wall 121 sufficiently that when the first guide member 142 is in the open position as shown in FIG. 5 with the cam arm 154 urging the paddle 168 laterally, the surface 178 of paddle 168 continues to engage the release pin 176 and urge the spreader member 146 to the unblocked position.

Figure 7:
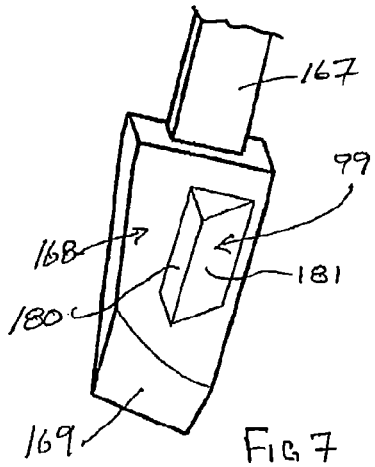
FIG. 7 is a schematic pictorial view of a forward end of the advance lever in FIG. 6 as seen from the first side opposite to that shown in FIG. 6.

As best seen in FIG. 7, the pawl 99 has a catch surface 180 and a camming surface 181. Referring to FIG. 9, the catch surface 180 of the pawl 99 is adapted to engage the catch surface 110 on a flange member 73 of the strap 13 such that movement of the pawl 99 with the forward arm 48 of the advance lever 46 in the direction indicated by the arrows 182 in FIG. 9 will advance the strap 13 in the strap feed channelway 129 in an advance stroke of the advance lever 46. On a return stroke of the advance lever 46, the pawl 99 and the forward arm 48 are moved in an opposite direction, that is, in the direction of the arrow 183. In so doing, when the camming surface 181 of the pawl 99 engages the cam surface 112 or the first shoulders 114 of the next flange member 73, the resilient plate 167 will become deflected laterally such that the pawl 99 will be moved laterally as seen in FIG. 9 as schematically illustrated by arrow 184. The pawl 99 will thus ride over the laterally outermost surface of the flange member 73 as it is further moved to the left as indicated by arrow 185. Upon the pawl 99 becoming disposed rearward of the catch surface 110 of the next flange member 73, the pawl 99 under the bias of the resilient plate 167 will be moved laterally inwardly as indicated by arrow 186 with the pawl 99 to become disposed in an engagement position with the catch surface 110 of the flange member 173 of the next segment 75 ready for advancing the screwstrip in a direction of the arrow 182.

In contrast with a lateral position to which the paddle 168 is biased laterally in normal cycling of the advance lever 46 to advance successive segments 75 of the strap 13, when the first guide member 142 is in the open position as shown, for example in FIG. 5, the paddle 168 and the pawl 99 are biased laterally away from the strap 13 beyond the positions that are shown in FIG. 9 such that the pawl 99 does not engage any portion of the strap 13.

The screwstrip 14 is engaged on the tool 12 by reason of passing through the guideway 82 of the slide body 20. In addition, a strap slideway 284 is provided coupled on the outside of the housing 18 on an entrance side 285 of the housing 18 to removably slidably engage the strap 13. As best seen in FIG. 10, the strap slideway 284 provides a channelway 286 extending forwardly therethrough with a pair of U-shaped arms 287 and 288 each having a respective bight 289 and 290 to receive the flange members 73 and permit the strap 13 to slide forwardly or rearwardly therethrough. Preferably, one arm 288 is pivotable laterally from a position shown in FIG. 10 in solid lines to a position shown in dotted lines so as to facilitate ease of insertion of a screwstrip 14 into a position in sliding engagement with the strap 13 within the strap slideway 284 without having to feed, for example, either end of the strap 13 through the slideway 284.

The tool 12 permits manual insertion of a screwstrip 14 into the tool 12 while the slide body 20 is in a fully extended position. With the tool in the fully extended position and no screwstrip 14 in the tool, a user engages the axle extension lever 160 moving this lever 160 to pivot the first guide member 142 to the open position as seen in FIG. 11. In the position of FIG. 11, the user then feeds an end of a strap 13 of a screwstrip 14 into the strip feed channelway 129 and slides the screwstrip 14 inwardly through the entranceway 83 to the guideway 82. The screwstrip 14 will slide within the guideway 82 with the flange members 73 engaged within the strip feed channelway 129 until the head 17 of the first screw 16 in the screwstrip 14 engages a radially inwardly stop portion 91 of the socket 127 carried on the rear wall 125 of the screw guide chamber 120. In this regard, reference is made to FIG. 4 which schematically illustrates in a side view in a plane including centrally through the strap feed channelway 129 and including the axis 52 of the driver shaft 34 and the axis of the screws 16, the cross-sectional profile of the forward portion of the rear wall 125 illustrating the socket 127 as having on the right-hand side which is remote from the entranceway 83 a forwardly extending stop portion 91 of the interior surface 92 of the socket 127 which stop portion 91 is adapted to engage the head 17 of the screw 16 preferably on at least a portion of a radially directed side surface 147 (shown on FIG. 3) of the head 17 of the screw which is directed radially. As seen in FIG. 4, the stop portion 91 extends forwardly, however, the stop portion 91 does not extend forwardly so far as to engage the web 70 of the strap 13 of a screwstrip 14 received in the strap feed channelway 129 in a manner which prevents advance of the screwstrip 14. On the entranceway side of the screw head engaging socket 127, the socket 127 is open rearwardly to a height above the rear upper surface 42 of the head 17 of a screw 16 permitting the head 17 to be advanced with the strap 13 towards the exitway 87 until the head 17 engages the stop portion 91 of the socket 127. The stop portion 91 preferably extends downwardly about the socket 127 circumferentially up to about 180 degrees about the socket on the side of the socket opposite to the entranceway 83. The engagement of the head 17 of the screw 16 in the screw head engaging socket 127 serves to locate the head 17 of the screw 16 such that the screw axis 39 at the head 17 of the screw 16 is coaxial with the axis 52 of the driver shaft 34. The interior surface 92 of the socket 127 forms an annular surface about the bore 33 including the annular drive portion 93 of the interior surface 92 adjacent to the bore 33. The annular drive portion 93 is directed forwardly, that is, as seen axially forwardly and partially radially inwardly. In contrast, the stop portion 91 is shown as directed principally as seen in FIG. 4 radially inwardly.

The annular drive portion 93 is adapted when it is urged forwardly into a screw head 17 to engage the screw head 17 and transmit forwardly directed forces to the screw head 17 to move the screw 16 forwardly. In addition, the annular drive portion 93 is preferably to serve as a centering cam surface to engage the screw head 17 and by such engagement cam and guide the screw head 17 into a coaxial location centered within the socket 127 relative the axis 52. As seen in FIG. 4, the annular drive portion 93 is shown as disposed coaxially about the bore 33 and coaxially about the axis 52. The annular drive portion 93 is shown to extend 360 degrees about the axis 52 and to decrease in diameter from axis 52 as it extends forwardly. The annular driver portion 93 has a profile which is concave facing forwardly and with central areas closely mirroring the rearwardly directed rear surface 42 of the screw head 17.

Referring to FIG. 11, with the first guide member 142 in the open position as shown, there is sufficient lateral space between the first guide member 142 in the open position and the closed second guide member 144 in the closed position that the shank 40 of the screw 16 may pass therebetween and become engaged within the one half guide tube 150 of the second guide member 144, however, with the shaft 40 of the screw 16 being deflected to a minor extent laterally towards the first guide member 142 in order to gain access to the one half guide tube 150 of the second guide member 144 as is aided by engagement of the shank 40 on the screw shaft camming surface 151 of the second guide member 144. With the head 17 of the screw 16 urged into the stop portion 91 of the socket 127 and the shaft 40 engaged within the half guide tube 150 of the second guide member 144, the user releases the axle extension lever 160 and the first guide member 142 returns under the bias of its spring 156 to the closed position as seen, for example in FIG. 13, with the shank 40 of the screw 16 engaged within and between the half guide tube 150 of the second guide member 144 and the half guide tube 158 of the first guide member 142. The two half guide tubes 150 and 158 together define a frustoconical screw guideway therebetween coaxially about the driver shaft axis 52. Each of the half guide tubes 150 and 158 are frustoconical tapering forwardly to a diameter substantially equal to the outside diameter of the threads 41 on the lower portion 36 of the shank 40 of the screw 16 so as to locate the lower portion 36 of the shaft 40 which passes through the lower portion of the half guide tubes 150 and 158 such that the screw axis 39 is coaxial with the axis 52 of the driver shaft 34 where the shank 40 passes through the lower portion of the half guide tube 150 and 158.

In operation of the tool 12, each successive screw 16 is advanced to a ready position engaged within the slide body 20 and held within the slide body with the axis of the screw 39 substantially in coaxial alignment with the axis 52 of the driver shaft 34 as seen in FIG. 13.

The particular configuration of the strap feed channelway 129 of the guideway 82 assists in locating the screw 16 coaxially relative with the axis 52 of the driver shaft 34 as schematically illustrated in FIG. 4. FIG. 4 illustrates the strap feed channelway 129 of the guideway 82 in side view showing between the dashed lines the bight 135 between the rear arm 132 and the forward arm 134 of one of the channel forming members 130 which are to receive and constrain the flange members 73 of the strap 13. The bight 135 of the strap feed channelway 129 is shown to be symmetrical about the axis 52 such that portions on the entranceway side of the axis 52 are mirror images of portions on the exitway side of the axis 52 as seen in FIG. 4. With the strap 13 preferably having relative inherently consistency in resiliency along the longitudinal of the strap 13, the uniform deflection of the strap 13 on either side of the axis 52 causes a U-shape curved deflection of the strap 13 matching the U-shape of the bight 135 in a manner such that the guideway constrains the strap 13 so that the inherent bias of the strap 13 causes it to assume a position in which the screw 16 to be advanced has its screw axis 39 substantially coaxially aligned with the driver shaft axis 52.

Each segment 75 of the strap 13 preferably is relatively rigid as enhanced by the sleeve 79 fixedly secured to the web 70 and providing a three-dimensional structure to the segment 75. The sleeve 79 engages the upper portion 37 of the shank 40 of the screw. The upper portion 36 of the shank 40 of the screw 16 forward of the head 17 is provided with a shape which is substantially the same as interior surfaces of the sleeve 79 such that each screw 16 is securely held in each segment 75 of the strap 13 coaxially aligned within the sleeve 79. Preferably, the forward end of the sleeve 79 is engaged on the threads 41 of the shank 40 of the screw 16 to resist axial movement of the screw 16 relative to the sleeve 79 prior to a screw 16 being rotated by the driver shaft 34 and to assist in drawing a screw when rotated forwardly relative the segment 75.

The screwstrip 14 may be provided to be of almost any length, however, a screwstrip 14 may have a length of approximately 12 to 16 inches. Each end 210 of a screwstrip 14 which is desired to be advanced into the guideway 82 preferably has at least one forwardmost segment 75 which does not contain a screw 16. Thus, preferably, a screwstrip 14 as shown in FIGS. 1 and 2 before use will have one segment 75 at each end which does not contain a screw.

The screwstrip 14 illustrated in FIGS. 1 and 2 is adapted for having either of its ends 210 fed into the entranceway 83 and, in this regard as seen in FIG. 9, if the screwstrip 14 shown in FIG. 9 were rotated 180 degrees as though its opposite end were fed first into the entranceway 83, then the flange members 73 and their rear catch surfaces 110 would continue to be orientated in the appropriate manner for engagement by the catch surface 180 of the pawl 99.

As seen in FIG. 13, the first guide member 142 and the second guide member 144 are spaced forwardly from the socket 127. As a result, the screw shank 40 is supported and engaged by the half guide tubes 150 and 158 at a location spaced forwardly from the screw head 17. Spacing the distance between (a) where the screw head 17 is to be engaged by the screw head engaging socket 127 and (b) where the half guide tube 150 and the half guide tube 158 engage the screw shank 40 is advantageous towards enhancing the extent to which the screw 16 has its screw axis 39 coaxially aligned with respect to the driver shaft axis 52 when engaged by the socket 127 and the half guide tubes 150 and 158.

Figure 14:
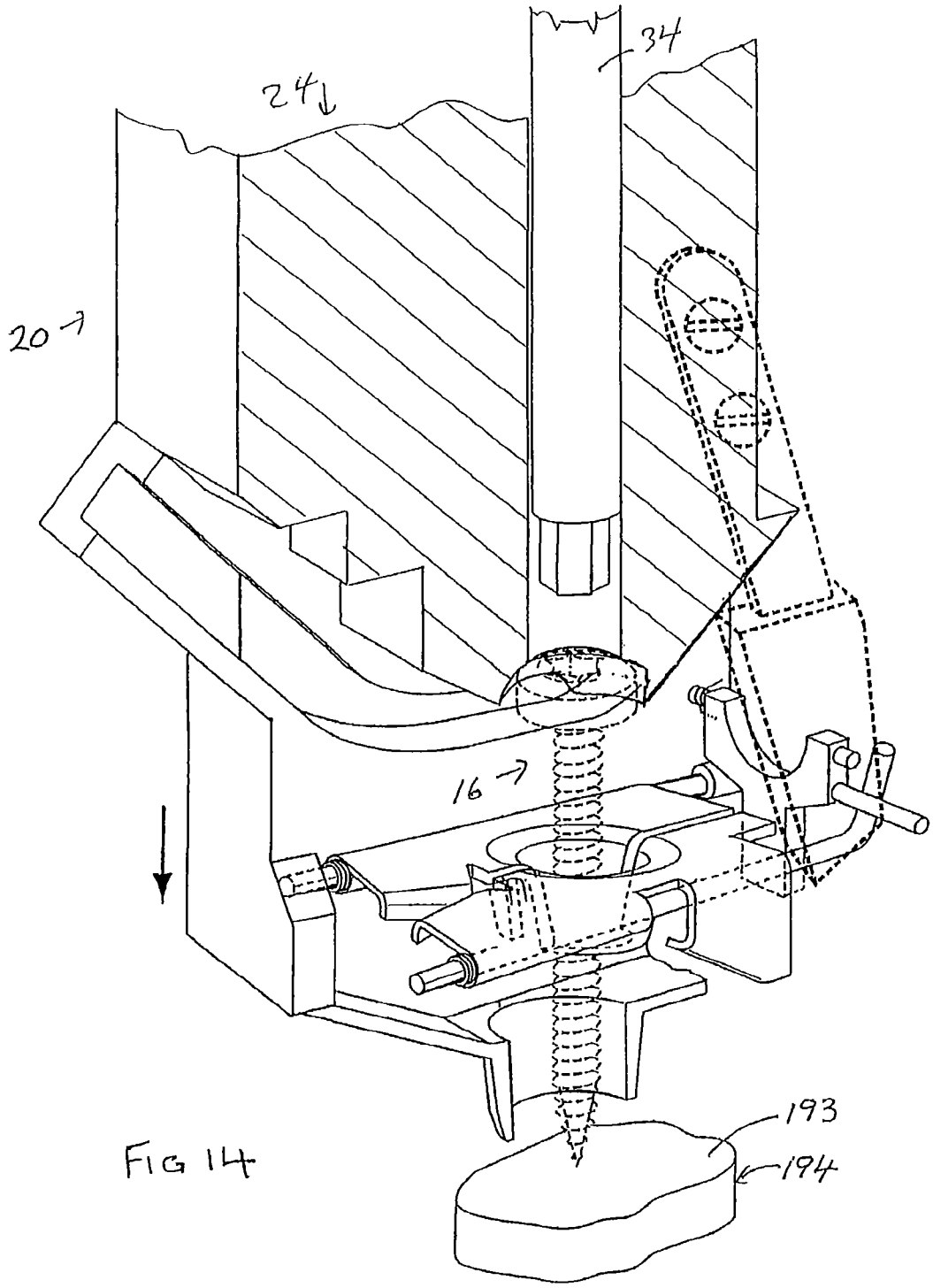
Figure 23:
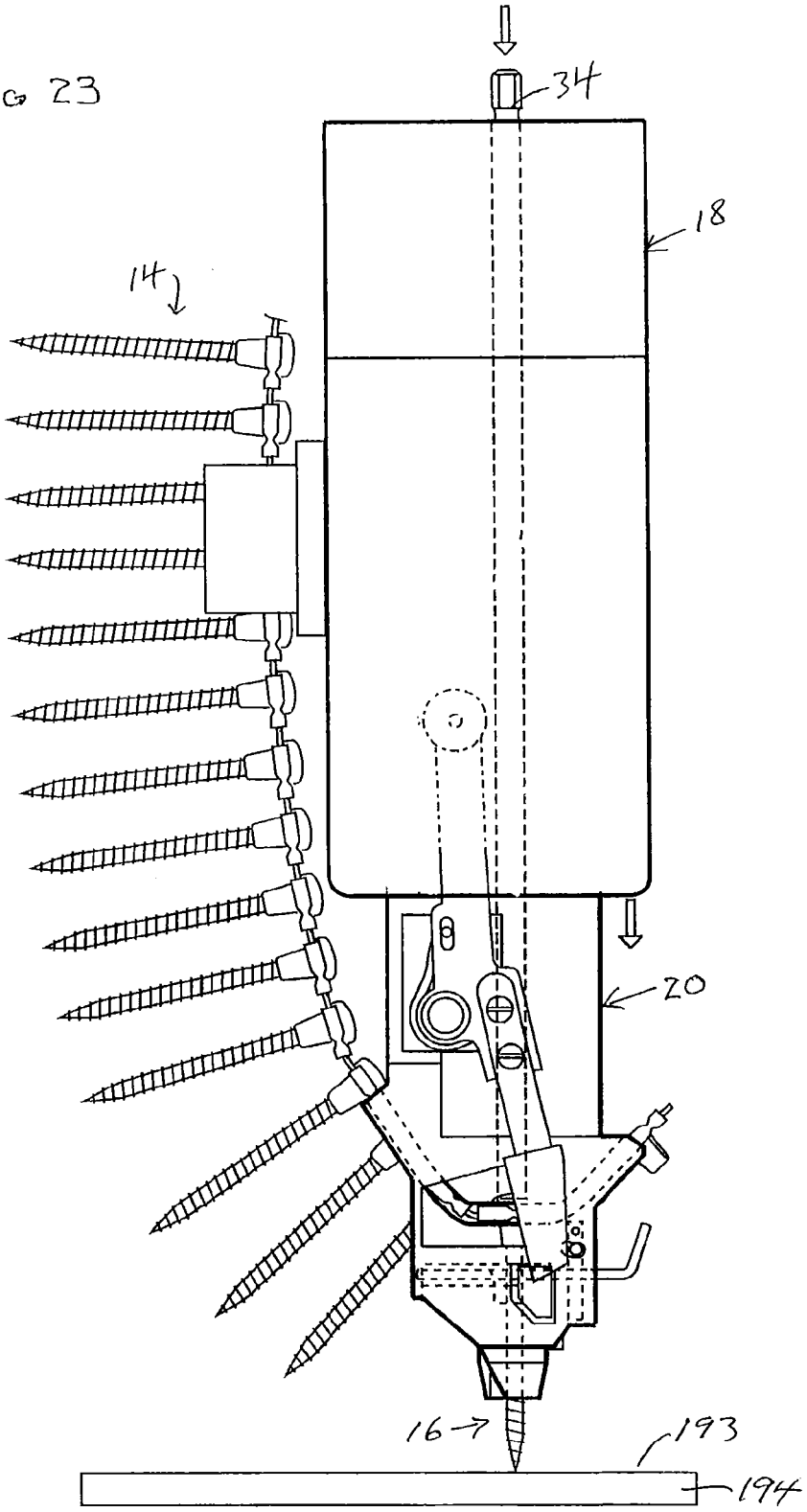

FIGS. 1, 2, 4 and 12 illustrate the tool 12 with the slide body 20 in an extended position and the screwstrip 14 engaged within the slide body 20 in a ready position for use. As best seen in FIGS. 4 and 13, the head 17 of the screw 16 is spaced axially forwardly from the axially directed drive portion 93 of the socket 127. In a first step in use in driving the screw, the tool 12 is manually moved to a first touch position as illustrated in FIGS. 13 and 22 in which the tip 15 is of the screw 16 to be driven merely touches the upper surface 193 of a workpiece 194 into which the screw is to be driven. In this first touch position as seen in FIG. 13, the head 17 of the screw continues to be spaced axially forwardly from the drive portion 93 of the socket 127. From the first touch position of FIG. 13, a user manually applies forces forwardly onto the power driver 11 so as to urge the housing 18 forwardly towards the workpiece 194. In a first forward motion step with the screw tip 15 engaged on the workpiece 194, the socket 127 on the slide body 20 moves downwardly such that the drive portion 93 engages the screw head upper surface 42 as seen in FIG. 14 and FIG. 23. In this first forward motion step, the slide body 20 is not moved relative to the housing 18. The screw 16 has become pinched between the workpiece 194 and the socket 127 by upward deflection of the strap 13 carrying the screw to be driven. This pinching serves to guide the screw head 17 to assume a coaxial position in the socket 127.

Figure 24:
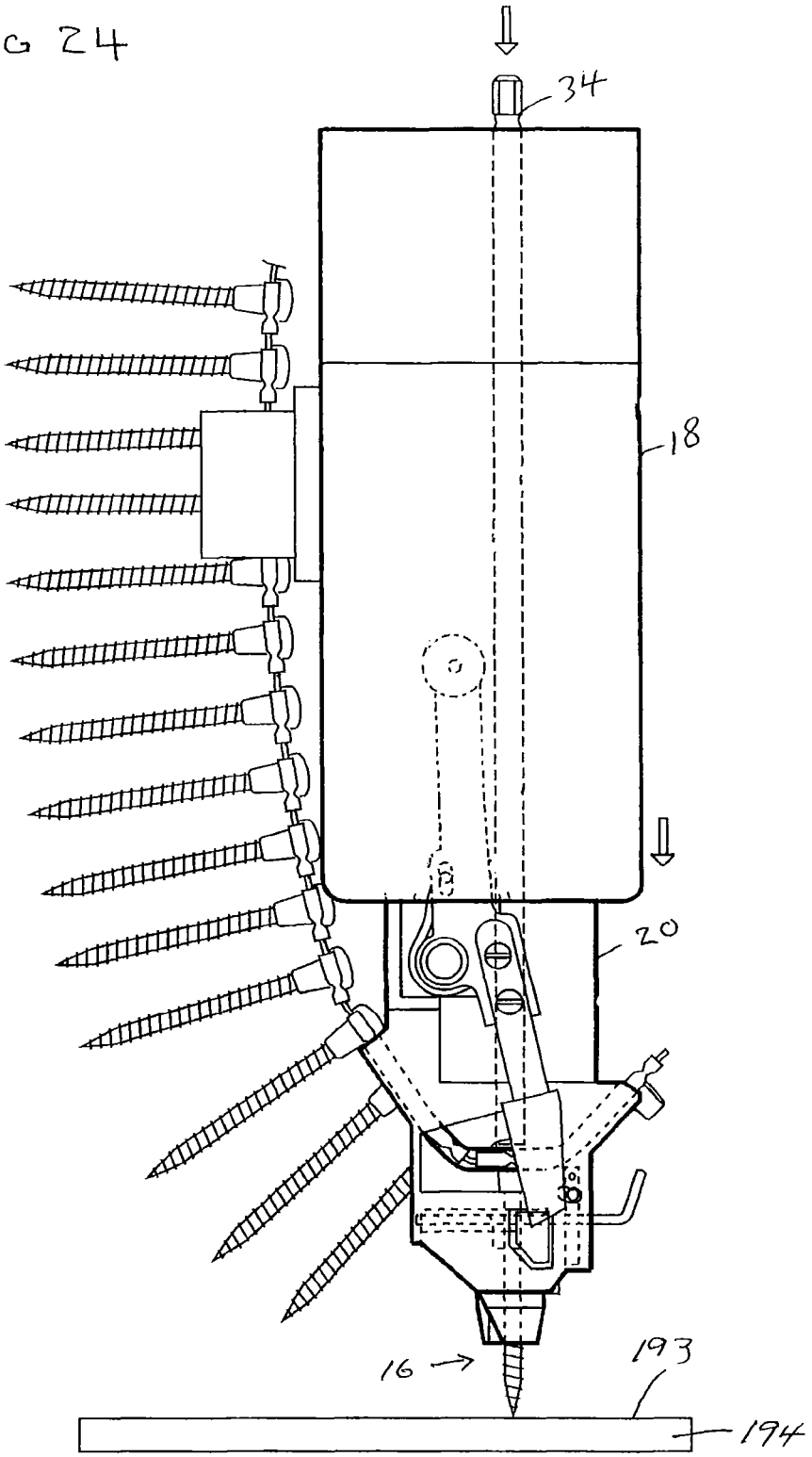

From the position of FIG. 14 in a second forward motion step, with the screw 16 pinched between the workpiece 194 and the slide body 20 by reason of the screw head 17 being received within the socket 127, downward movement of the housing 18 compresses the compression spring 38 and moves the housing 18 forwardly relative the slide body 20, that is, moving the slide body 20 from a fully extended position towards a retracted position. With such relative movement of the housing 18 relative to the slide body 20, the rotating driver shaft 34 comes to have its bit 35 become engaged within the screw head recess 43 as shown in FIG. 15 and FIG. 24.

Figure 15:
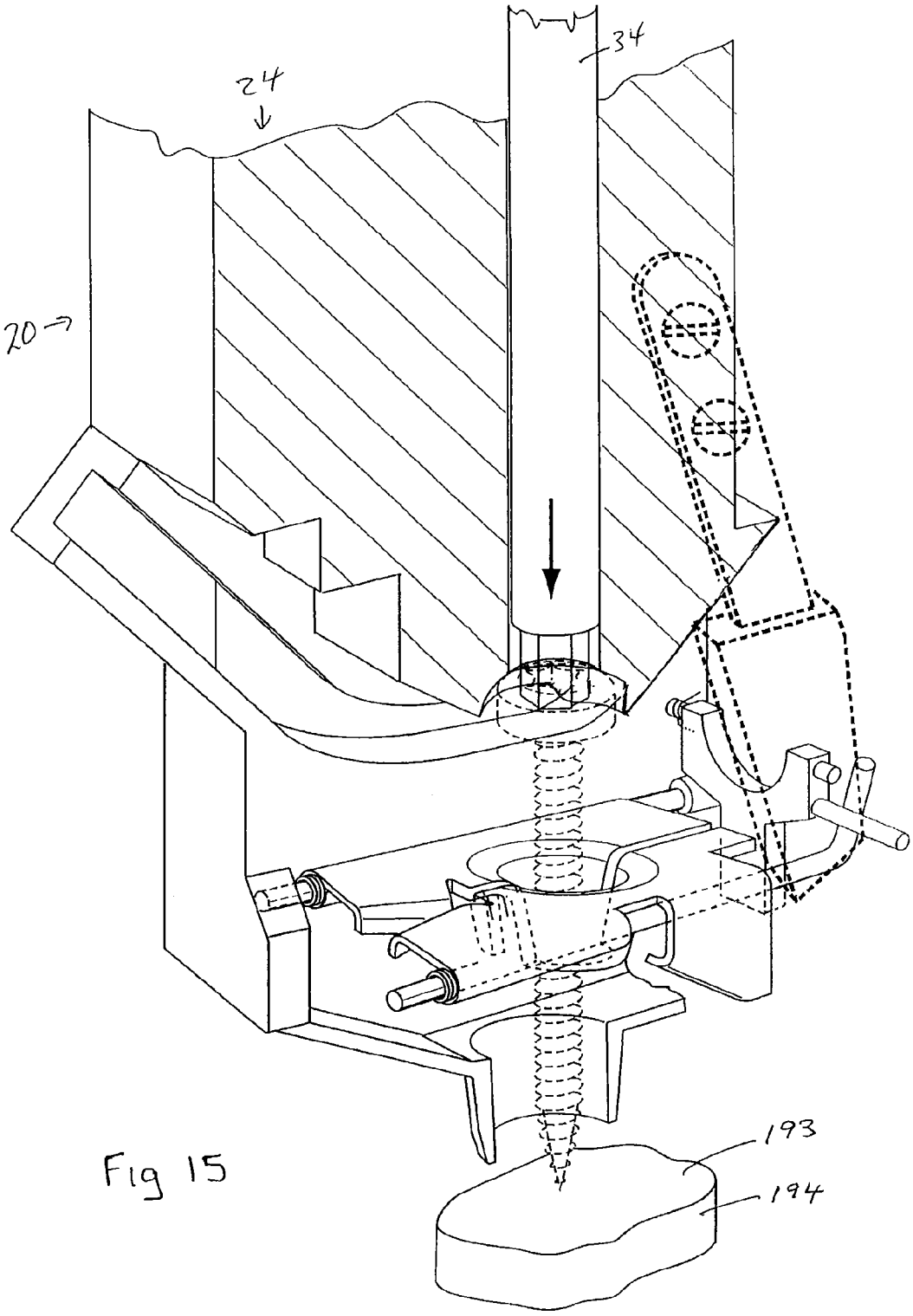
Figure 16:
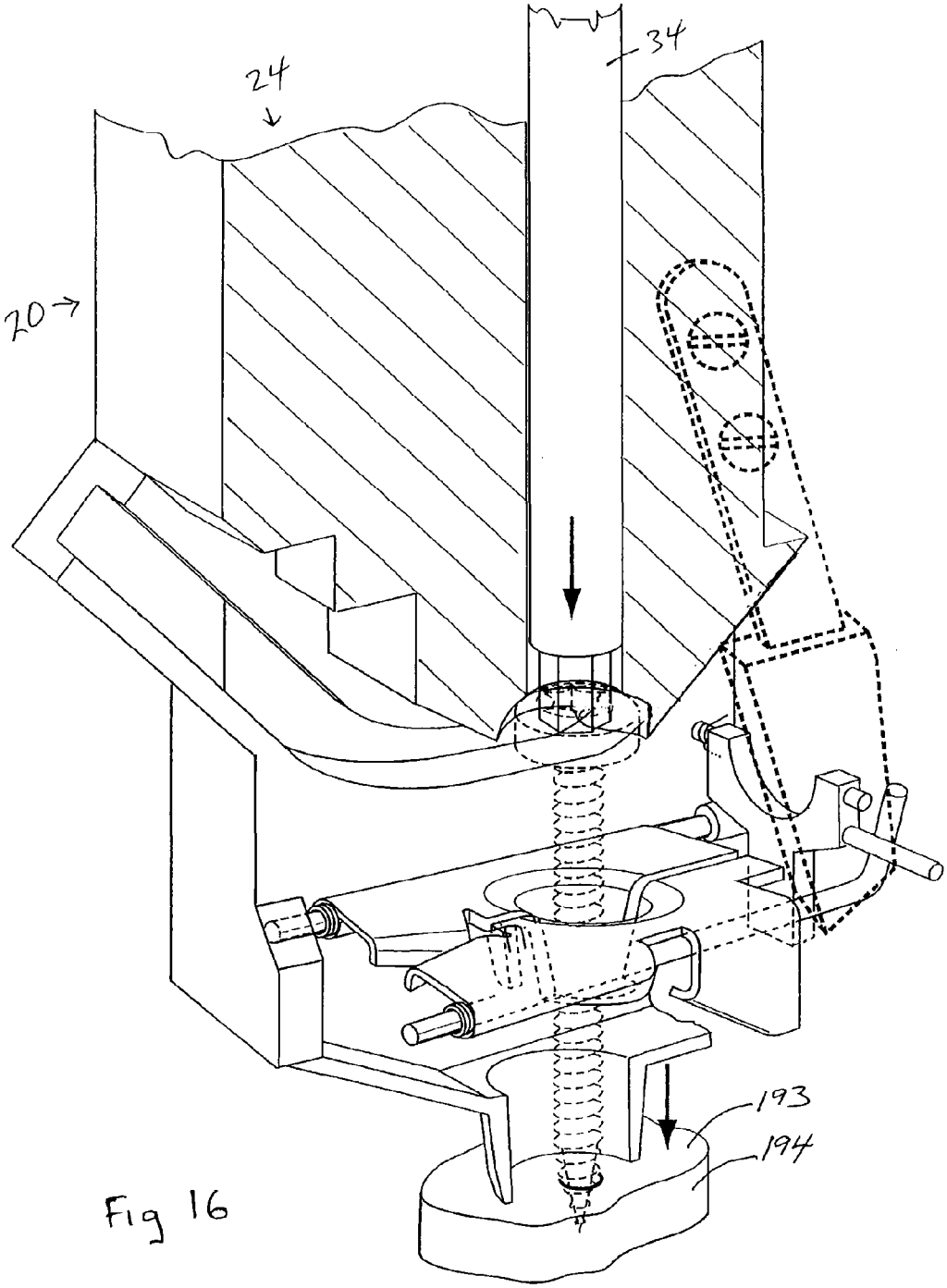

In FIG. 15, as is the case with each of FIGS. 13 and 14, the touch down foot 140 carried on the nose portion 24 remains spaced rearwardly of the upper surface 193 of the workpiece 194 enabling a user to precisely locate the screw tip 15 at a desired location on the upper surface 193 of the workpiece 194 signified, for example, in FIG. 13 by an "X" marked as 195 in dashed lines on the upper surface 193 of the workpiece 194. In a second forward step, in moving from the position of FIG. 15 to the position of FIG. 16, the screw 16 has been rotated by the driver shaft 34 with the driver shaft bit 35 engaged on the blind end of the screw head recess 43 to apply forwardly directed forces as well as rotational forces to the screw 16 rotating the screw such that the screw is threaded forwardly into the workpiece 194 to a position as shown in FIG. 16 in which the touch down foot 140 engages the upper surface 193 of the workpiece 194 as shown in FIG. 16. In moving from the position of FIG. 15 to the position of FIG. 16, the compression spring 38 urges the slide body 20 forwardly relative the housing 18 and thus urges the socket 127 into the screw head 17, albeit preferably with not substantial force given that the spring 38 is only compressed a small extent.

Figure 26:
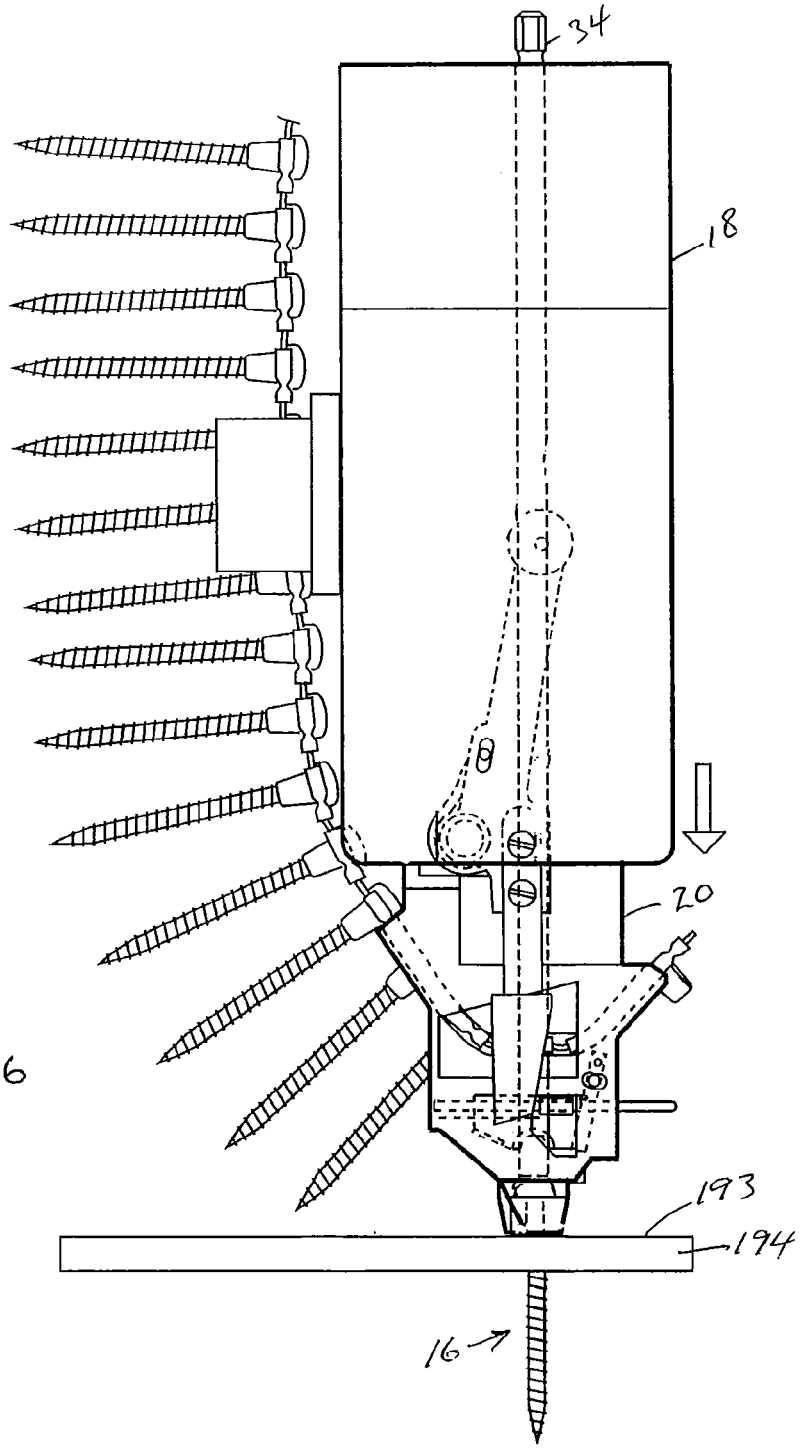

From the position of FIG. 16 in a third forward step, with the touch down foot 140 of the slide body 20 engaging the workpiece 194, further forward movement of the slide body 20 is prevented such that forward movement of the housing 18 compresses the compression spring 38 with forward movement of the housing 18 relative the slide body 20 urging the screw 16 forwardly relative to the slide body 20 and thus moving the screw head 17 forwardly out of engagement with the socket 127. The screw 16 is subsequently driven into the workpiece 194 forwardly relative to the slide body 20 with the screw head 17 moving downwardly into engagement with the first guide member 42 and the second guide member 43 such that engagement of the uppermost portion 36 of the screw shank 40 and the screw head 17 with the first guide member 142 and the second guide member 144 urges each of the first guide member 142 and the second guide member 144 to pivot to an open position as seen in FIG. 17 in which open position there is sufficient clearance between the first guide member 142 and the second guide member 144 to permit the screw head 17 as well as the driver shaft 34 to pass forwardly therebetween. In the screw 16 moving downwardly to engage the first guide member 142 and the second guide member 144, the frustoconical upper portion 37 of the screw shank 40 and the rear surface 142 and side surface 147 of the screw head 17 may come into engagement with plate portions 149 and 157 and an enlarged rear portion of each of the half guide tubes 150 and 158 assisting in camming the first guide member 142 and the second guide member 144 from the closed position to the open position. As seen in FIG. 17, with relative movement of the housing 18 relative to the slide body 20 towards a retracted position, the forward end 56 of the advance lever 46 is moved to the left out of engagement with the release pin 176 of the spreader member 146 such that the spreader member 146 under the bias of the coil spring 175 pivots towards the blocked position. As seen in FIG. 17, with the first guide member 142 and the second guide member 144 each in the open position, the space between the plate portions 157 and 149 is greater than the lateral width of the stop leg 172 permitting the spreader member 146 to pivot to its blocking position as shown in FIG. 17 in which the stop leg 172 is disposed between the plate portion 157 of the first guide member 142 and the plate portion 149 of the second guide member 144 maintaining the first guide member 142 and the second guide member 144 substantially in the open position and against moving further towards their closed positions. The position of FIG. 17 is also illustrated in FIG. 26.

Figure 27:
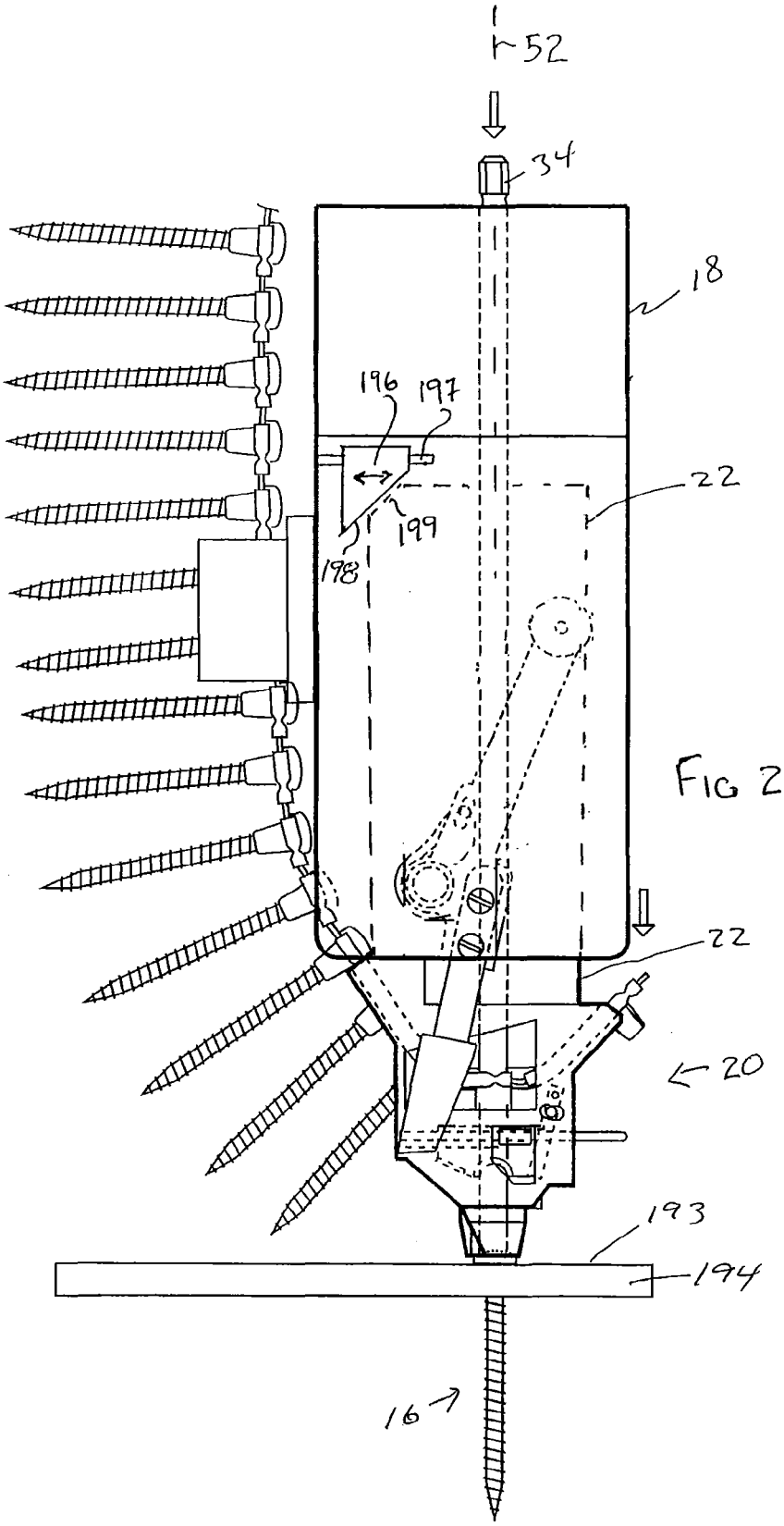

With further downward movement of the housing 18 from the position of FIG. 17, the housing 18 moves downwardly relative to the slide body 20 to a position as illustrated in FIG. 18 and FIG. 27 in which the screw 16 has been driven into the workpiece 194 fully with the screw head 17 engaging the upper surface 193 of the workpiece. FIGS. 18 and 27 effectively represent a fully retracted position of the housing 18 and slide body 20 and in which the forward end 56 of the forward arm 48 of the advance lever 46 has moved a maximum distance to the left away from the release pin 176. FIG. 18 represents the end of the steps in which the housing is directed by a user forwardly into the workpiece. In the fully retracted position shown in FIG. 18, the pawl 99 carried on the advance lever 46 is moved to a position rearwardly of the catch surface 110 of the flange member 73 of the next segment 75 as in a manner which has been illustrated with respect to FIG. 9 and ready to advance the screwstrip 14 on movement of the pawl 99 to the right as seen in FIG. 9 with subsequent extension of the slide body 20 relative to the housing 18.

Figure 19:
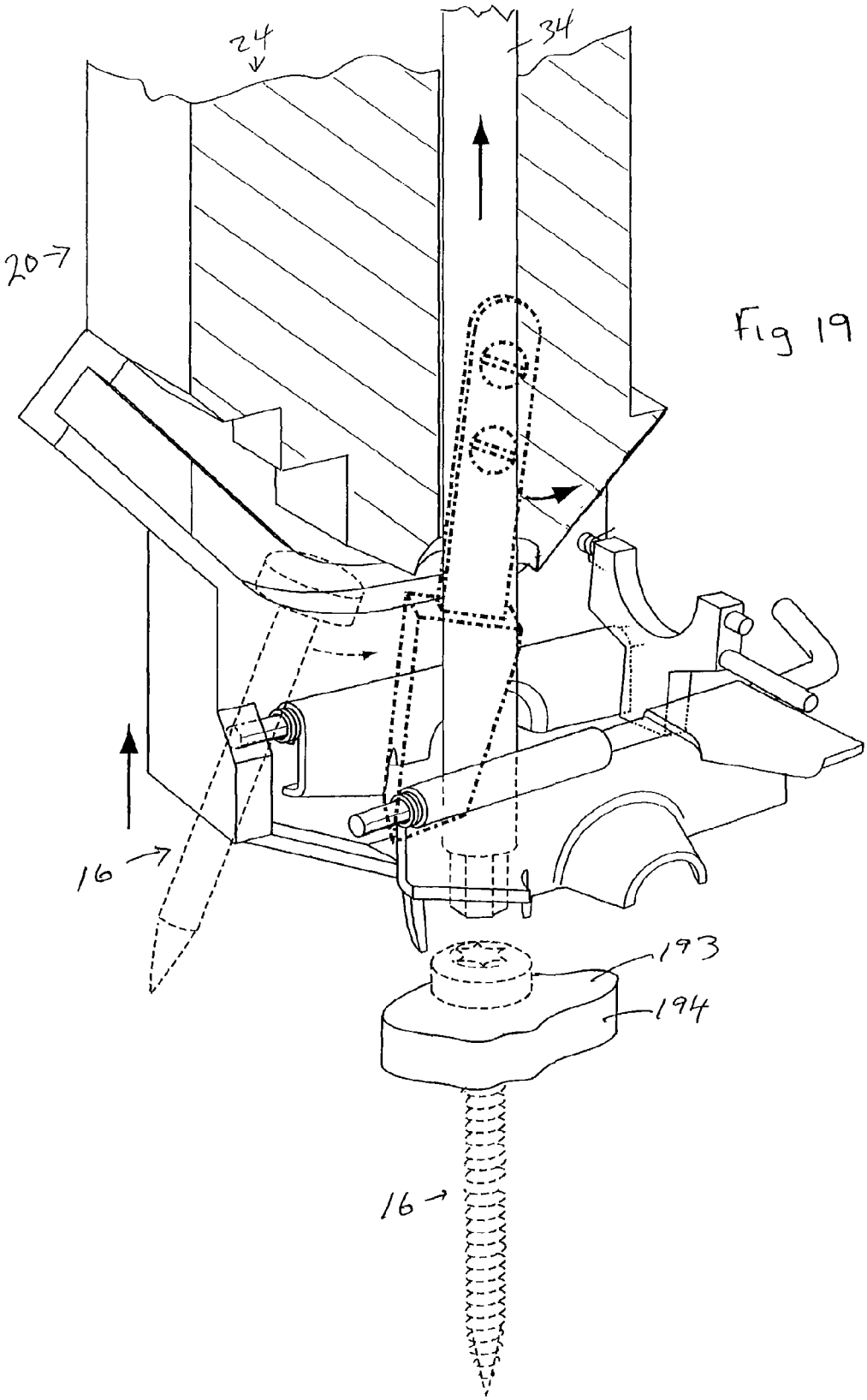
Figure 20:
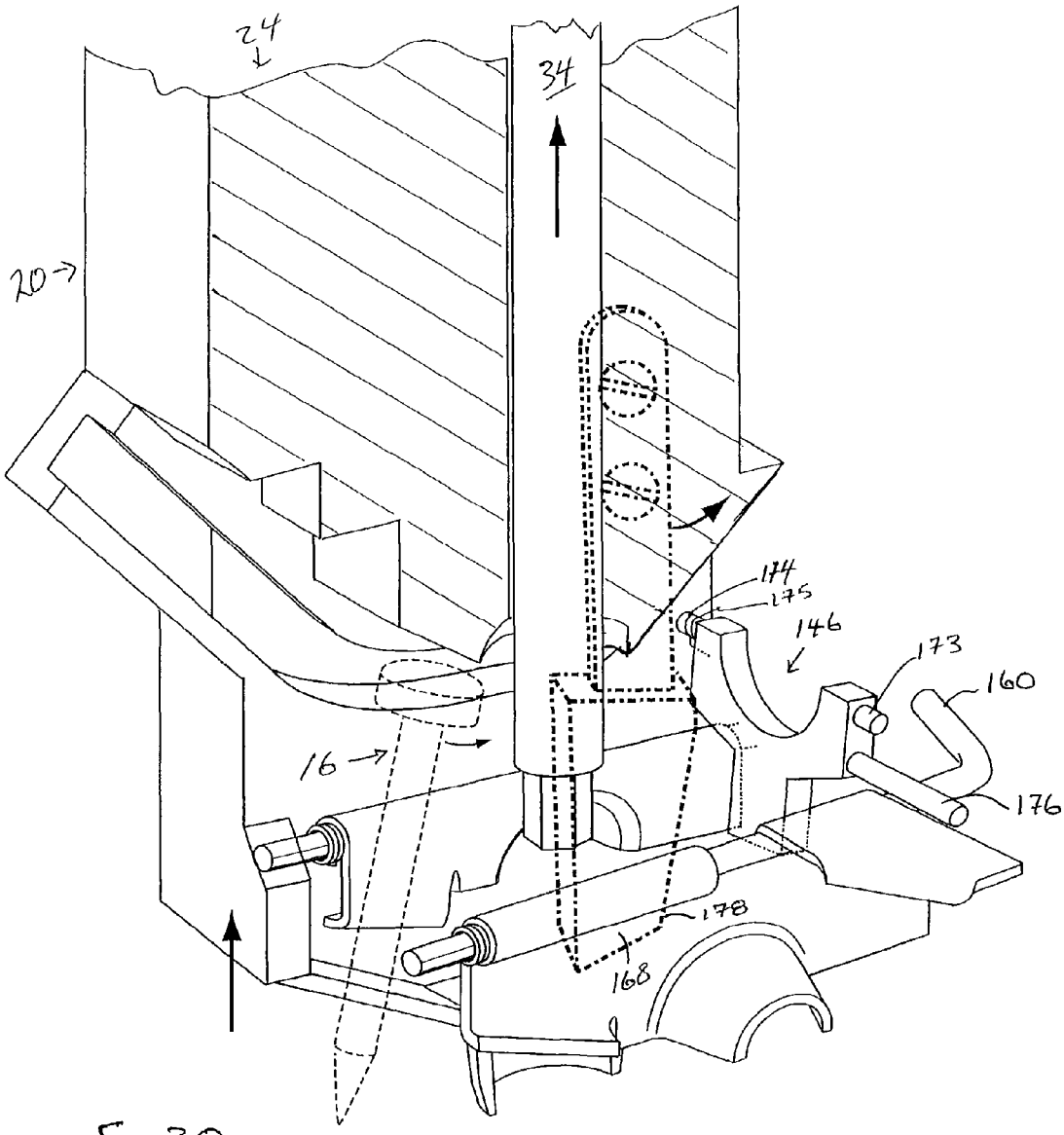
Figure 28:
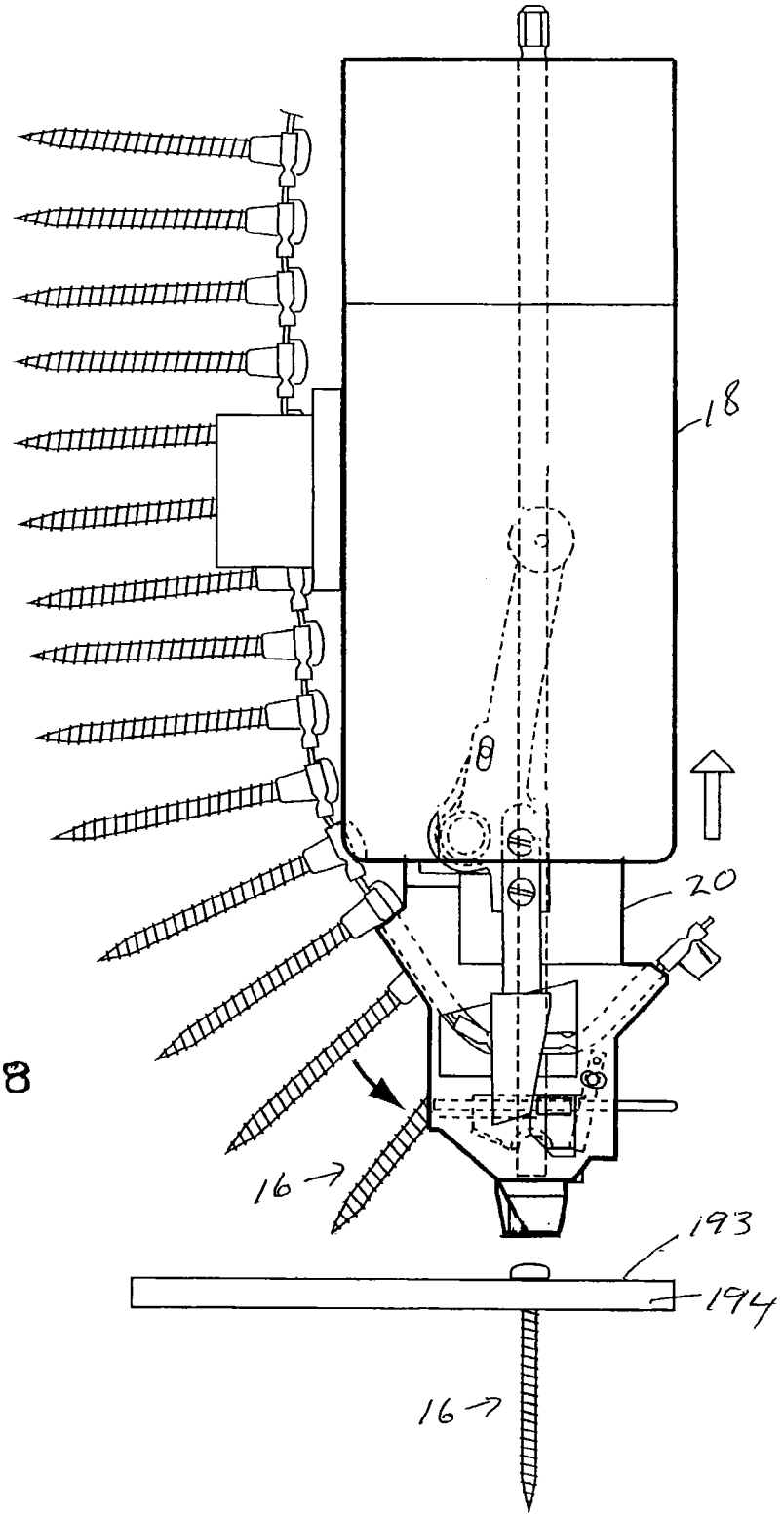

After reaching the fully retracted position as illustrated in FIGS. 18 and 27, a user will manually move the power driver 11 rearwardly away from the workpiece 194 and, in so doing, release compression forces applied to the compression spring 38. As a result, the compression spring 38 will urge the slide body 20 and the housing 18 axially apart, that is, to move the slide body 20 from the retracted position towards an extended position relative the housing 18. Such relative movement of the slide body 20 towards the extended position relative the housing 18 causes the forward end 56 of the forward arm 48 of the advance lever 46 with the pawl 99 carried thereon to move in an advancing direction, that is, towards the right as seen in FIG. 18, with such movement advancing the screwstrip 14 by reason of the pawl 99 being engaged with the rear catch surface 110 of the flange member 173 of the next segment 75. FIG. 19, for ease of illustration, does not show the strap 13 and merely shows two screws 16, the screw 16 driven into the workpiece and another screw 16 being the screw previously adjacent the screw which has been driven into the workpiece 194. FIG. 19 illustrates the forward end 56 of the advance lever 46 being moved to the right, the slide body 20 being moved upwardly, and the housing 18 being moved upwardly albeit with the housing 18 as symbolized by the driver shaft 34 moving upwardly a greater extent than the slide body 20. FIG. 28 illustrates in side view substantially the same position as illustrated in FIG. 19. From the position in FIG. 19, with further extension of the slide body 20 relative the housing 18 by the compression spring 38, each of the forward end 56 of the advance lever 46 and the screws 16 are shown as being advanced further towards the right as in FIG. 20.

Figure 29:
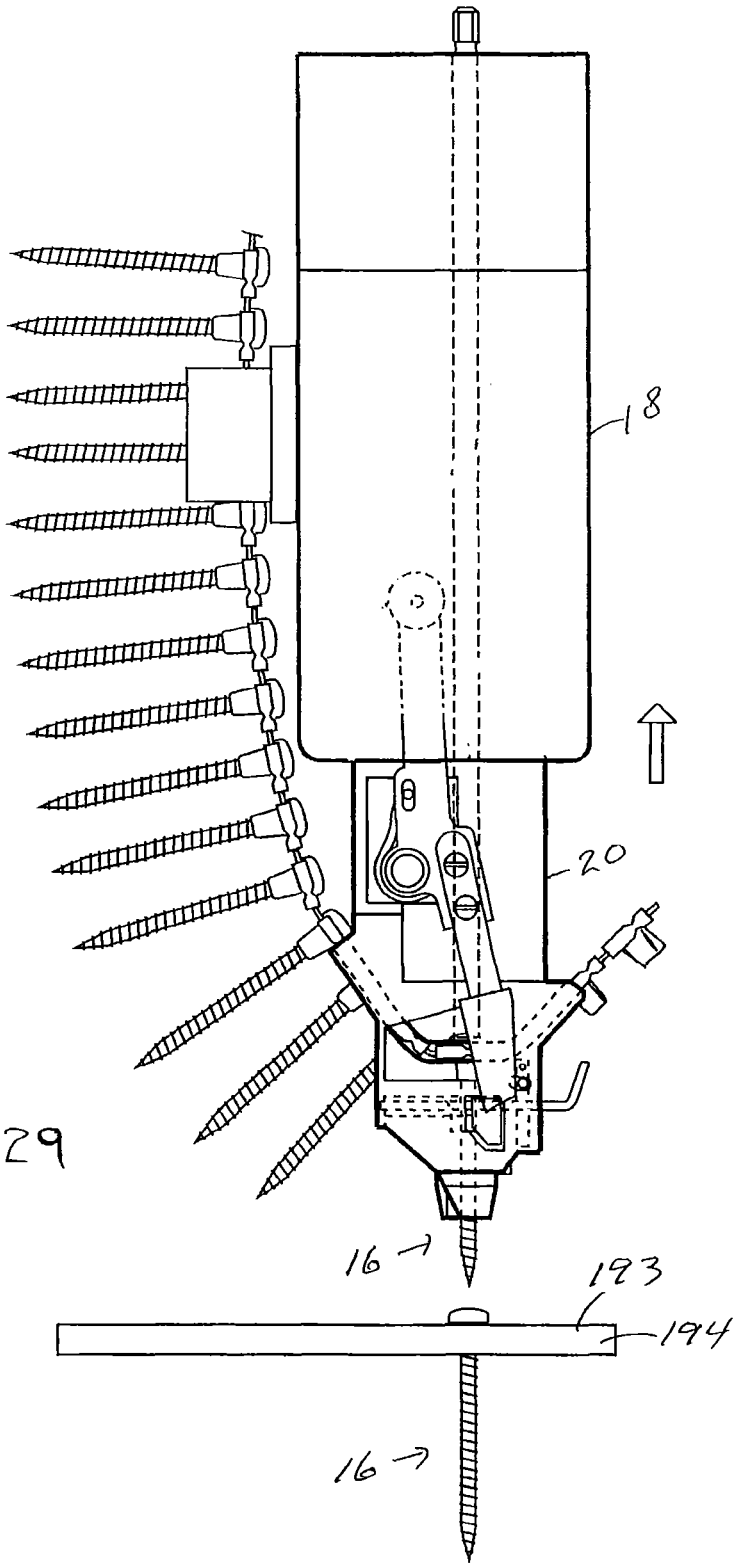

As seen in each of FIGS. 17, 18, 19 and 20, the first guide member 142 and the second guide member 144 continue to be held in the open position by the spreader member 146. FIG. 28 illustrates a condition substantially the same as FIG. 20. From the position of FIG. 20, the tool moves to the condition shown in FIG. 21 as also shown in FIG. 29. In moving from the position of FIG. 28, the forward end 56 of the actuating lever 46 continues to be moved towards the right, the strap 13 has been moved by the pawl 99 to the right to a position in which the head 17 of the screw 16 is engaged by the stop portion 91 of the socket 127 and in the last movement of the forward end 56 of the advance lever 46, after the screw 16 has been moved such that its head 17 is engaged by the stop portion 91 of the socket 127, the paddle 168 on the advance lever 46 engages the release pin 176 of the spreader member 146 moving the release pin 176 towards the right with the stop leg 172 to become disengaged from between the plate portions 157 and 159 of the first guide member 142 and the second guide member 144 after the screw 16 has been located substantially coaxially of the driver shaft axis 52. The tool 12 in the position shown in FIG. 29, and corresponding FIG. 21, has the screw 16 to be driven in a ready position, the same position as that shown, for example, in FIGS. 1 and 2 and a cycle of operation can thus be repeated by a user again urging the power driver 11 carrying the tool 12 forwardly into a workpiece.

In operation of the tool 12, the slide body 20 moves relative the housing 18 in a cycle of operation in which the slide body 20 moves in a retracting stroke from the extended position to the retracted position and then moves in an extending stroke from the retracted position to the extended position. Engagement between the cam roller 61 and the surfaces of the cam slot 64 will determine the relative rotational position of the advance lever 46. The cam slot 64 is therefore selected so as to provide the desired relative position of the advance lever 46 and therefore its camming paddle 168 and pawl 99 having regard to the relative position in the stroke, that is, the relative position of the slide body 20 relative to the housing 18 and whether the slide body 20 is in a retracting stroke or an extending stroke. Configuration of the advance lever 46 and its cam roller 61 and the configuration of the cam slot 64 may be made in a known manner as, for example, in the manner disclosed by above-mentioned U.S. Pat. No. 6,453,780, the disclosure of which is incorporated herein.

FIG. 22 schematically shows in solid lines the cam slot 64 having a front end 67, a rear end 68 and with the first camming surface 65 extending on the left-hand side between the first end 67 and the second end 68 and the second camming surface 66 extending on the right side between the first end 67 and the second end 68. The spring 69 biases the advance lever 46 counter-clockwise such that the cam roller 61 is inherently biased into the first camming surface 65. In any position in the cycle of operation, whether the cam roller 61 will engage the first camming surface 65 or the second camming surface 66 will depend on a number of factors. Most significant of these factors involve resistance to movement of the forward end 56 of the advance lever 46 as compared to the strength of the spring 69 biasing the forward end 56 towards the right as seen in FIG. 22. Under conditions in which the bias of the spring 69 is dominant over resistance to a movement of the advance lever forward end 56, then the bias of the spring 69 will place the cam roller 61 into engagement with the first camming surface 65 with relative movement of the advance lever 46 relative the position of the slide body 20 in the housing 18 to be dictated by the profile of the first camming surface 65. Under conditions where the resistance to movement of the advance lever forward end 56 is greater than the force of the spring 69, then the cam roller 61 will engage the first camming surface 65 or the second camming surface 66 depending on the direction of such resistance and whether the slide body 20 is in the retracting stroke or the extending stroke. For example, in the extension stroke, when the pawl 99 is engaging and advancing the strap 13 and the resistance offered to advance by the strap 13 is greater than the force of the spring 69, then the cam roller 61 will engage on the second camming surface 66 with relative motion of the advance lever 46 relative the position of the slide body 20 in the housing 18 to be dictated by the profile of the second camming surface 66.

For normal operation of the tool 12 in accordance with the present invention, in a retracting stroke, the cam roller 61 moves from the front end 67 of the cam slot to the rear end 68 of the cam slot in rolling engagement with the first camming surface 65 and, in an extending stroke, the cam roller 61 moves from the second end 68 of the cam slot to the first end 67 of the cam slot in rolling engagement with the second camming surface 66. In this manner, in identical positions of the slide body 20 and the housing 18, the cam roller 61 engages the first camming surface 65 in the retracting stroke and the second camming surface 66 in the extending stroke such that the advance lever 46 places its forward end 56 at different positions relative the identical positions of the slide body 20 in the housing in a retracting stroke, then in an extending stroke. This arises in that, amongst other things, different portions of the first camming surface 65 and the second camming surface 67 have different profiles spaced by distances greater than the diameter of the cam roller 61. In the embodiment illustrated, approximate each of the front end 67 of the cam slot and the rear end 68 of the cam slot, the cam slot has a width only marginally greater than the diameter of the cam roller 41 and the first camming surface 65 and the second camming surface 66 have substantially the same profiles. Over other portions of the first camming surface 65 and the second camming surface 66, the first camming surface 65 and the second coming surface 66 have different profiles spaced by distances substantially greater than the diameter of the cam roller 61. Engagement of the cam roller 61 in the front end 67 of the cam slot 64 preferably also serves as a mechanism to limit extension of the slide body 20 out of the housing 18 to a maximum under the bias of the compression spring 68 and representing the fully retracted position.

Figure 25:
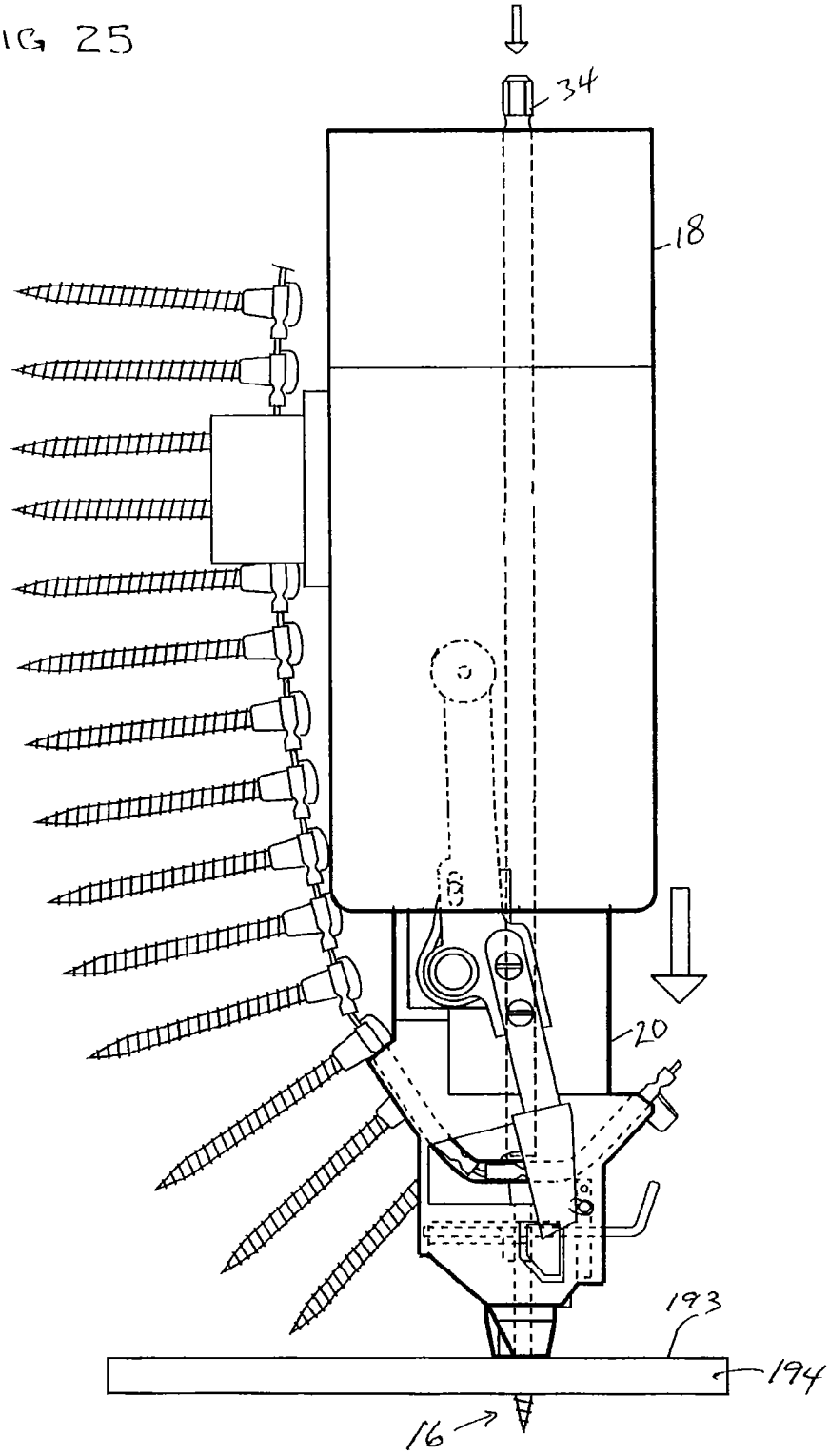

On FIG. 22, two circles in dotted lines have been shown marked with the designations P25 and P27 as representing the relative positions of the cam roller 61 in the cam slot 65 respectively in FIGS. 25 and 27.

Portions of each of the first camming surface 65 and the second camming surface 66 are straight and parallel to the driver shaft axis 52. When the cam roller 61 moves over these portions of the camming surfaces which are parallel to the axis 52, there is no relative rotation of the advance lever 46 relative to the slide body 20 and such straight portions of the camming surfaces parallel to the axis 52 in effect provide lost link motion portions where relative movement of the slide body 20 compared to the housing does not translate into relative pivoting of the advance lever 46. In contrast, when the cam roller 61 moves over portions of the first camming surface 65 and the second camming surface 66 which are disposed at an angle to the axis 52 then with relative movement of the slide body 20 compared to the housing 18, the advance lever 46 pivots relative to the slide body 20.

The tool 12 is preferably provided with an adjustable depth stop mechanism which can be used to adjust the fully retracted position, that is, the extent to which the slide body 20 may slide into the housing 18. An adjustable depth stop mechanism such as illustrated in above-mentioned U.S. Pat. No. 6,453,780 may be adopted. FIG. 27 schematically shows a depth setting cam member 196 which is secured to the housing 18 for sliding transversely of the housing as in the direction of the arrow and with a rotatable worm gear 197 for moving and fixing the depth setting cam member 196 at any particular lateral position relative to the housing 18. The cam member 196 has a cam surface 198 disposed at an angle to the axis 52. A portion of the cam surface 198 is axially aligned with a rearwardly directed depth stop surface 199 as schematically shown in FIG. 22 carried on the rear portion 22 of the slide body 20. By suitable positioning of the depth stop cam member 196 laterally relative to the housing 18, the extent to which the slide body 20 may slide into the housing 18 may be set, that is, the slide body 20 is prevented from sliding further into the housing 18 when the depth stop surface 199 on the slide body 20 engages the depth stop cam surface 198 on the housing. The depth stop mechanism controls the extent to which screws are driven into a workpiece and, for example, can control the extent of any desired countersinking.

The tool 12 in the embodiment is adapted for use with screws in which the maximum diameter of any portion of the screw 16 rearward of the first guide member 142 and the second guide member 144 is less than the spacing between the first guide member 142 and the second guide member 144 when each of these guide members are in the open position. The maximum diameter of the screw 16 rearward of the first and second guide members 142 and 144 typically is the maximum diameter of the head 17 of the screw. The tool 12 may be used with screws which have different head diameters provided the head diameters are smaller than this maximum diameter. Similarly, the tool is adapted for use with a driver shaft 34 which has a diameter less than the maximum distance the first guide member 142 and the second guide member 144 are laterally spaced when they are open.

While the embodiment illustrates the recess 43 in the screw head 17 as being hexagonal, various other recesses may be provided including star shaped such as Phillips and square shape such as Robertson. The screw 16 has been illustrated as having underneath its head 17 an upper portion 37 of the shaft 40 which is frustoconical. This upper portion 37 is not necessary. The screw has been illustrated as having its shank 40 substantially threaded with a simple thread of constant pitch throughout its length other than over the upper portion 37 underneath the head 17. This is not necessary and there is no need for the shank 40 to be continuously threaded or threaded with threads of only one diameter or pitch.

The tool 12 is adapted for use with screws of different lengths. Preferably, each different screwstrip 14 will have a set of screws of the same length. Different screwstrips may be provided with screws of different lengths. The tool 12 will function in driving screws of almost any length provided that the distance from the rear surface 42 of the head 17 of the screw 16 to the tip 15 of the screw is greater than the distance from the drive portion 93 of the socket 127 to the first guide member 142 and the second guide member 144, such that when the screw head 17 is engaged in the socket 127 the screw shank 40 is engaged between the first guide member 142 and the second guide member 144. If, when the tool 12 is in the ready position, the screw tip 15 does not extend forwardly beyond a forward surface 202 of the touch down foot 140, then the tool 12 will remain operative to drive the screw into the workpiece, however, there will not be the opportunity to easily locate the tip 15 of the screw 16 at a desired location on the surface of the workpiece before driving the screw. Preferably, therefore, in accordance with the present invention, when in the ready position as, for example, shown in FIG. 2, the screw will have a length such that with its head 17 proximate the socket 127, the tip 15 of the screw 16 extends forwardly beyond the forward surface 202 of the touch down foot 140. The length of screws that can be used with the tool 12 of the present technology is not limited. Insofar, for example, that screws are used in the tool 12 which are longer than the screws 16 shown in FIG. 2, then the screw in the ready position will necessarily space the tip 15 of the screw 16 further forwardly from the tool 12 and thus provide proportional additional room for the next screw to be disposed at an angle to the workpiece and avoid contact with the workpiece 194 as is the case, for example, in FIG. 22.

In the first embodiment, with the screw 16 in a ready position such as shown in FIG. 4 and FIG. 13, the screw 16 has been advanced held by the strap to a position in which the head 17 of the screw 16 engages the stop portion 91 of the socket 127 and the screw head 17 is disposed spaced forwardly from the annular drive portion 93 of the socket 127. Subsequently, after the tip 15 of the screw 16 first engages the workpiece 194, forward movement of the tool 12 moves the slide body 20 downwardly preferably with the annular drive portion 93 engages the head 17 of the screw 16 and guides the screw 16 into coaxial location centered within the socket 127 relative to the axis 52.

Figure 30:
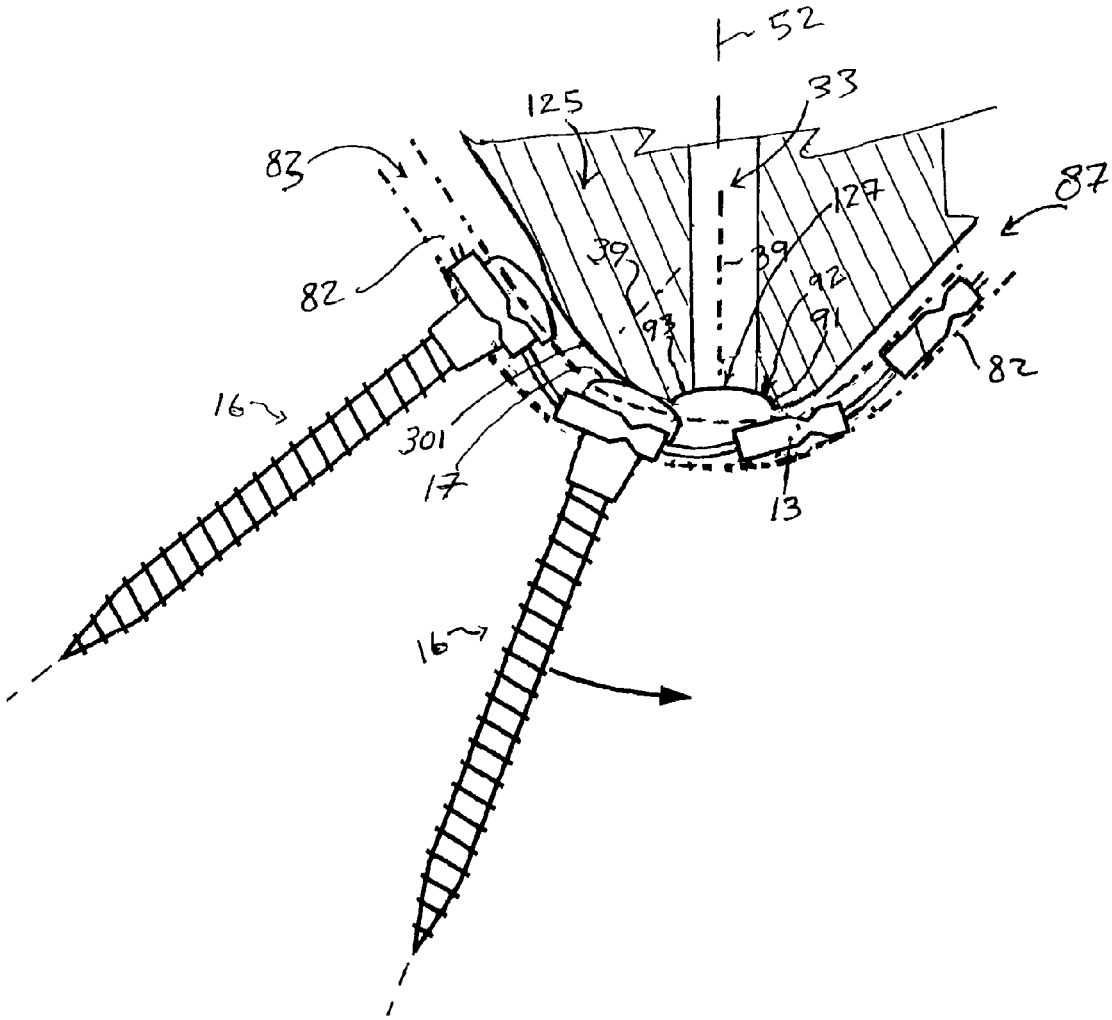
FIG. 30 is a schematic enlarged side view similar to FIG. 4 but of a tool in accordance with a second embodiment of the present technology showing the screw being advanced in the tool.
Figure 31:
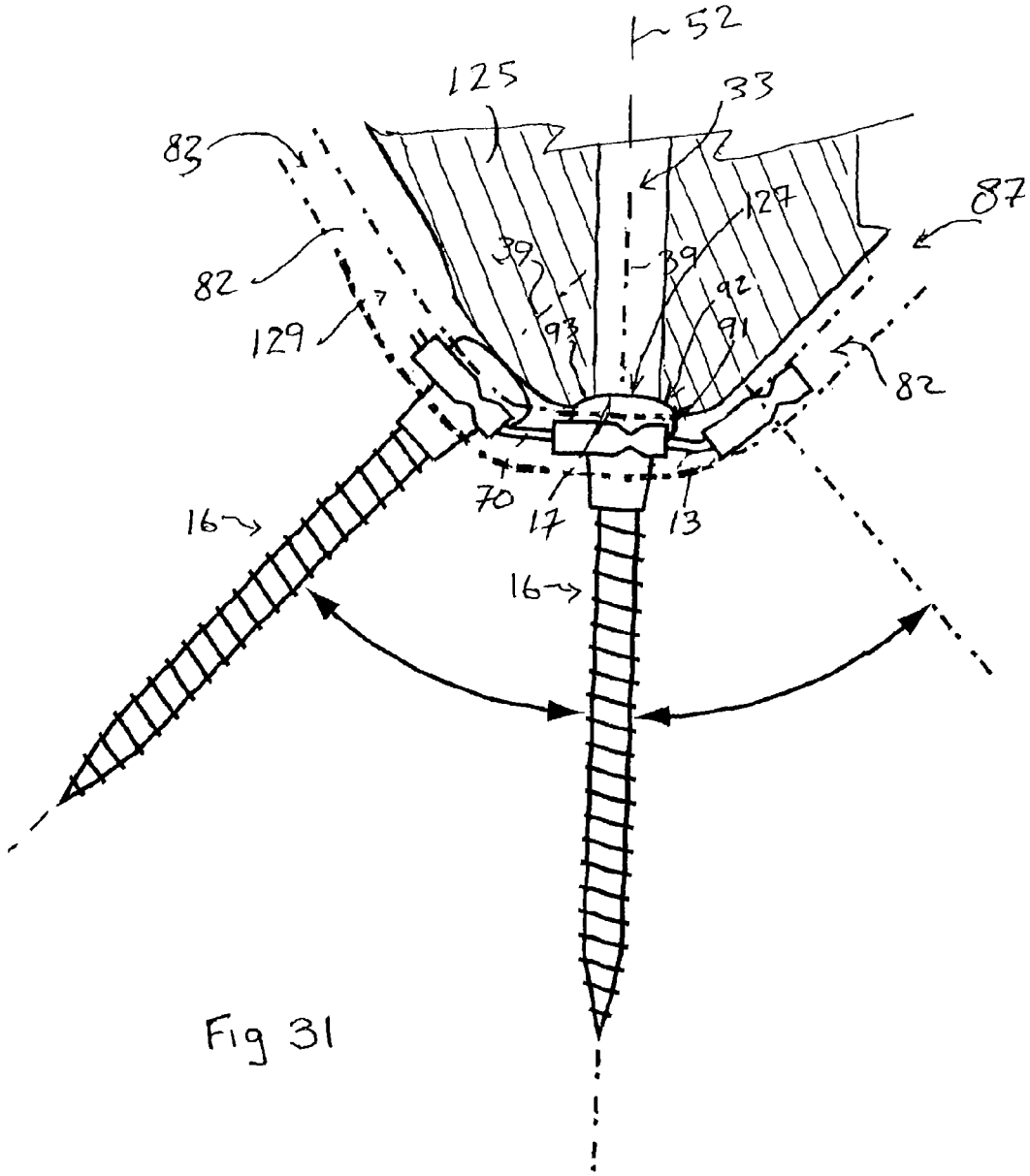
FIG. 31 is a view the same as shown in FIG. 30 but with the screw advanced to a ready position.

FIG. 30 schematically illustrates in a second embodiment of the present technology an alternate arrangement. FIG. 30 is a cross-sectional view of substantially the same as that shown in FIG. 4, however, notably with the profile of the rear wall 125 changed where it forms the uppermost part of the head channel 136 to receive the head 17 of the screw 16 and also the width of the strap feed channelway 129 changed. In FIG. 30, the screwstrip 14 is illustrated in a position in which the next screw 16 to be driven is being advanced towards the right as shown by the arrow. In this position, the head 17 of the screw 16 is shown as being engaged with a forwardly directed rear surface 301 of the rear wall 125. The engagement of the head 17 with the rear surface 301 results, at least in part, due to the pawl 99 advancing the screwstrip 14 and friction between the strap 13 and the feed strap channelway 129 which will tend to urge the screwstrip rearwardly. FIG. 31 shows a cross-sectional view the same as in FIG. 30 but in which the screw 16 has been advanced towards the right to be axially aligned with the axis 52 of the driver shaft 34. In FIG. 31, due to the forces tending to urge the screwstrip rearwardly as developed due to the pawl 99 drawing the strip to the right and the inherent resiliency of the screwstrip, the head 17 of the screw 16 has become seated in the socket 127 engaged with the annular drive portion 93 without being spaced forwardly therefrom.

In movement from the position of FIG. 30 to the position of FIG. 31, a screw head 17 engages the stop portion 91 to stop advance and is urged rearwardly into the forwardly directed rear surface 301 of the rear wall 125 such that when the screw head 17 reaches the socket 127, the screw head 17 moves rearwardly into engagement in the socket 127. On such rearward movement of the screw head 17 into the socket 127, engagement between the socket 127 and screw head 17 prevents further advance of the screwstrip 14 to the right as shown. The screw 16 is located in a position coaxial above the axis 50 in a position ready to be driven. As seen in FIGS. 30 and 31, as represented by the strap feed channelway 129, the bight 135 between the rear arm 132 and the forward arm 133 is sized to have a front to rear width measured normal the longitudinal of the strap 13 proximate the entranceway 83 and proximate the exitway 87 to relatively closely receive the flange members 73 of the strap therebetween. However, as the strap feed channelway 129 becomes closer to the axis 52, the channelway 129 increases in front to rear width so as to permit the strip to move rearwardly from the position of FIG. 30 to the position of FIG. 31.

The specific nature of the screwstrip 14 being advanced including the flexibility of the strap 13 will be relevant in selecting a preferred profile for the feed strap channelway 129 which will permit operation as described in FIGS. 30 and 31. The engagement of the head 17 and the rear surface 301 of the rear wall 125 result in frictional forces which need to be overcome to advance the screwstrip and need to be considered in adopting any particular configuration for the tool. In the preferred first embodiment, the socket 127 includes particularly the stop portion 91 for engagement with the head 17 of the screw 16 to have the screw being advanced stopped at a desired position where the screw head 17 is substantially axially aligned with the axis 52. In the second embodiment illustrated in FIGS. 30 and 31, the equivalent of the stop portion 91 overlaps with the annular drive portion 93 insofar as the annular drive portion 93 is at least partially radially inwardly directed toward the axis 52. Alternatively in the embodiments of FIGS. 30 and 31, a more pronounced forwardly extending stop portion 91 may be provided similar to that in FIG. 4.

Figure 32:
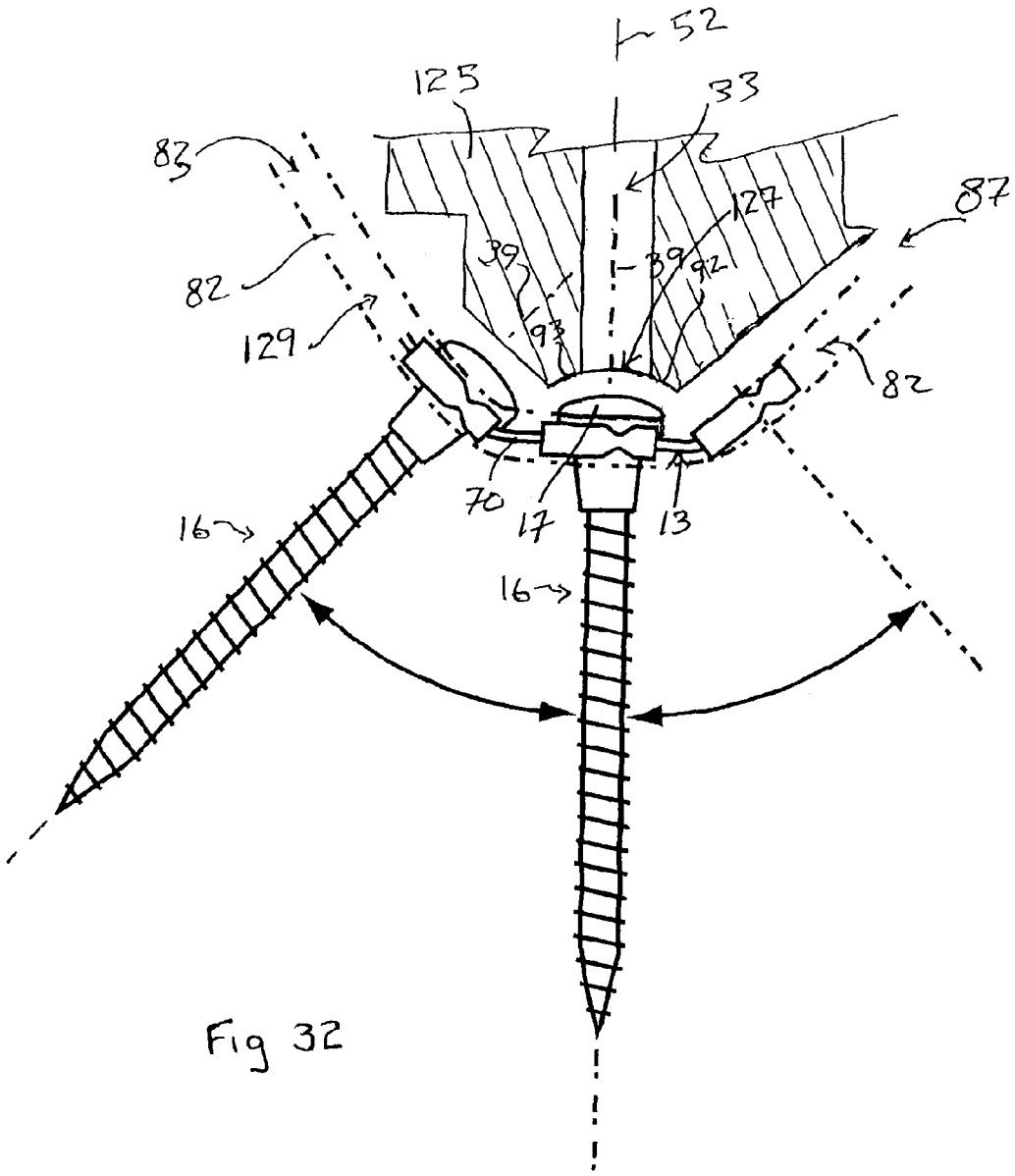
FIG. 32 is a schematic enlarged side view the same as in FIG. 4 but of a tool in accordance with a third embodiment of the present technology showing a screw advanced to the ready position.

The particular nature of the pawl 99 and its arrangement as shown in the first embodiment can be used to accurately advance the strap 33 to a desired position in the feed strap channelway 129 at the end of each stroke preferably to locate each screw 16 with its head 17 substantially coaxially aligned with the axis 52 without the head 17 engaging the recess 127 at all. Where the pawl 99 will locate the next screw to be driven with its head 17 coaxial with the axis 52 then the configuration of a recess substantially shown in FIG. 4 could be used with the screw head 17 advanced to assume a position spaced forwardly of the recess 127. Such an arrangement is schematically illustrated in FIG. 32, effectively representing the same arrangement as in FIG. 4 but with the socket 127 having the forwardly extending stop portion 91 shown in FIG. 4 removed. In such an arrangement, the socket 127 preferably extends radially of the screw head 17 to some extent such that as the socket 127 is moved downwardly to engage the head 17 of the screw 16, the concave or frustoconical surfaces of the annular drive portion 93 of the socket 127 will cam the screw head 17 into a centered position coaxially with the axis 52.

The embodiment illustrates the use of a particular screwstrip of a flat tape type and with a particular configuration using the flange members 73 for advancement by the pawl 99. Other configurations of screwstrips including flat tape screwstrips and axial screwstrips may be used with a tool in accordance with the present invention. Various mechanisms may be provided for advance of the screwstrips through a guideway to locate successively each screw to be advanced axially in line with the driver shaft. The particular nature of the advance mechanism is not limited to lever mechanisms such as the advance lever 46 shown. Rather various rotating wheels and shuttle arrangements or other advance mechanisms may be used in accordance with the present invention. As well, various different guides and channels may be used to guide the screwstrip and its strap and screws in their advance or location within the slide body 20. If an axial screwstrip is to be used, the strap may be disposed in an arc so as to locate the axes of the screws in a flat plane including the arc such as disclosed in above-noted U.S. Pat. No. 6,453,780 which is incorporated herein by reference. The curved arc of the axial screwstrip can assist in preventing the next screw to be driven from engaging the work surface.

The particular nature of the screwstrip to be used in accordance with the present technology is not limited. For example, screwstrips may have screws carrying washers on the shaft of the screw at a location forward of the touch down foot when in the advanced position so as to permit driving of screws having similarities to those described in U.S. Pat. No. 4,930,630 to Habermehl, issued Jun. 5, 1990, the disclosure of which is incorporated herein by reference.

The embodiment illustrates an arrangement with the advance lever 46 and its cam roller 61 carried on the slide body 20 and the cam slot 64 carried on the housing 18 so as to provide desired movement of the advance lever 46 with relative movement of the slide body 20 relative to the housing 18 in the extending stroke and the retracting stroke. However, many other mechanisms may be provided to translate the movement of the slide body 20 relative to the housing 18 in a cycle of operation and provide for desired timing and relative location of various mechanisms for advance of the screwstrip and driving of each screw including the manipulation of elements such as the spreader member 46. U.S. Pat. No. 6,453,780 illustrates two different arrangements and various other motion translation mechanisms may be utilized in accordance with the present invention.

The present technology has been described with reference to use of the tool as driven by a manually operated and manipulated power driver 11. While this is a embodiment, this is not necessary and the tool 12 could be adapted for automatic or robotic use.

The embodiment provides the first guide member 142 as carrying the axle extension lever 60 permitting manual movement of the first guide member 42 to an open position to permit manual insertion of the screwstrip 14. The manual movement of the first guide member 142 to an open position is also of assistance to withdraw any screwstrip 14 from engagement with the tool 12 and can be useful, for example, in the event of a jammed situation or the like.

The embodiment of the tool 12 shows merely the first guide member 142 as having the axle extension lever 60 permitting its opening. It is to be appreciated that both of the first guide member 142 and the second guide member 144 could be provided with similar manually operated axle extension levers or alternatively a separate mechanism could be provided to manually open both the first and second guide members 142 and 144 at the same time. The provision of a manual mechanism to open one of the first guide member 142 or the second guide member 144 is not necessary but advantageous.

The embodiment shows that in the downward movement of a screw 16 being driven, the screw head 17 engages the first guide member 142 and the second guide member 144 to move them to the open position. Other arrangements may be provided for opening these guide members including an actuator carried on the housing 18.

The tool 12 in accordance with the present technology is adapted to drive a single screw. For example, with the screwstrip 14 removed, and the first guide member 142 in the open position, the tool 12 may be placed about a single screw with the head of the screw received in the socket 127 and the shank 40 of the screw engaged between the first guide member 142 and the second guide member 144. This can be advantageous, for example, in using the tool to drive a separate new screw as, for example, where one particular screw of a different size or length may be desired than the screws in the screwstrip. As well, driving a single screw can be useful insofar as it is desired to complete the driving of a screw which may have only partially become engaged in a workpiece due to a jamming situation which prevented the screw from being fully driven.

The technology illustrated, for example, in FIG. 2 shows the advance lever 46 disposed on one side of the slide body 20. Preferably, a protective shroud (not shown) may be provided attached to the nose portion 24 of the slide body 20 laterally outside of the camming paddle 68 of the advance lever 46 to protect it from damage or engagement with workpieces and the like yet without constraining the ability of the paddle 68 to be deflected laterally or otherwise move as is required for proper operation of the tool 12.

While the technology has been described with reference to various embodiments, the technology is not so limited. Many variations and modifications will now occur to persons skilled in the art. For a definition of the invention, reference is made to the appended claims.

What is claimed is:

1. An apparatus for driving with a power driver a screwstrip comprising threaded screws which are joined together in a strip comprising:

a housing;

an elongate drive shaft for operative connection to a power driver for rotation thereby and defining a longitudinal axis;

a bit at a forward end of the drive shaft for engagement with a head of a screw, a slide body coupled to the housing for displacement parallel to the axis of the drive shaft between an extended position and a retracted position;

the slide body having:

(a) a guide channel for said screwstrip extending through said slide body generally transverse to the axis;

(b) a screw feed activation mechanism coupled between the slide body and the housing whereby displacement of the slide body relative the housing between the extended position and the retracted position advances successive screws through the guide channel to an initial screw position axially in alignment with said drive shaft for engagement in driving of each screw by the bit carried at the forward end of the drive shaft forwardly into a workpiece, and (c) a forwardly directed touch down foot to engage the workpiece;

wherein with the slide body in the extended position relative the housing the screw in the initial screw position extends forwardly to a tip of the screw, wherein from the extended position with the screw in the initial screw position with moving of the housing forwardly toward the workpiece the touch down foot engages the workpiece, whereupon with forward movement of the housing toward the workpiece engagement of the touch down foot with the workpiece causes the housing to move relative the slide body towards the retracted position such that the bit in engagement with the head of the screw drives the screw into the workpiece, wherein the slide body includes a pair of shank guide members, each shank guide member engaging a shank of the screw spaced forwardly from the head of the screw toward the tip to locate the shank axially in alignment with said drive shaft and the shaft of the screw is engaged by each of the shank guide members rearward of the touch down foot, each of the shank guide members is mounted to the slide body for relative movement between a closed position and an open position, in the closed position, the shank guide members positioned to entrap therebetween the shank of the screw to locate the shank axially in alignment with said drive shaft, and in the open position, the shank guide members defining an access passageway through which the shank is advanced by the screw feed activation mechanism to a position with the shank between the shank guide members axially in alignment with said drive shaft, wherein on moving the housing forwardly toward the workpiece after the screw is driven sufficiently forwardly into the workpiece the shank guide members are moved to the open position to permit the screw and driver shaft to pass forwardly therepast, the slide body carries a spreader mechanism to maintain the shank guide members in the open position after the screw has been driven past the shank guide members until the screw feed activation mechanism advances a next screw in the strip adjacent the screw being driven to the initial position, the spreader mechanism includes a spreader member movable between an unblocking position and a blocking position, in the blocking position the spreader mechanism having a leg received between the shank guide members maintaining the shank guide members in the open position against movement to the closed position.

2. The apparatus claimed in claim 1 wherein each of the shank guide members is pivotably mounted to the slide body for pivoting between the closed position and the open position, in the open position the shank guide members spaced apart from each other defining the access passageway therebetween.

3. The apparatus claimed in claim 2 wherein each shank guide member is spring biased to assume the closed position.

4. The apparatus claimed in claim 1 wherein the shank guide members have rearwardly directed camming surfaces, wherein on moving the housing forwardly toward the workpiece after the screw is driven sufficiently forwardly into the workpiece an enlarged diameter portion of the screw rearward on the screw from the shaft engages the camming surfaces of the shank guide members to pivot the shank guide members to the open position.

5. The apparatus claimed in claim 1 wherein:

in the open position the shank guide members are spaced apart from each other sufficiently that the leg may pass therebetween on the spreader mechanism moving from the unblocked position to the blocking position, and in the closed position the shank guide members block the leg of the spreader mechanism from passing therebetween on moving the spreader mechanism from the unblocking position towards the blocking position.

6. The apparatus claimed in claim 5 wherein the shank guide members have rearwardly directed camming surfaces, wherein on moving the housing forwardly toward the workpiece after the screw is driven sufficiently forwardly into the workpiece an enlarged diameter portion of the screw rearward on the screw from the shaft engages the camming surfaces of the shank guide members to pivot the shank guide members to the open position whereupon the spreader mechanism is moved from the unblocking position toward the blocking position to move the leg in between the shank guide members, wherein on moving the housing further forwardly toward the workpiece sufficiently that the screw passes forwardly past the shank guide members, the shank guide members are kept in the open position against closing under their spring bias to assume the closed position by the leg engaged therebetween, and wherein on moving the housing further forwardly toward the workpiece sufficiently that the screw is substantially fully driven into the workpiece, the screw feed activation mechanism after advancing a next screw between the shank guide members into alignment with the axis moves the spreader mechanism toward the unblocked position thereby moving the leg from between the shank guide members permitting the shank guide members to move under their spring bias to the closed position about the shank of the next screw.

7. The apparatus claimed in claim 6 wherein the spreader mechanism is pivotably mounted to the slide body for pivoting between the unblocking position and the position blocking position, and the spreader mechanism is spring biased toward the blocking position.

8. The apparatus claimed in claim 7 wherein in the open position the shank guide members are spaced apart from each other sufficiently that the leg may pass therebetween under the spring bias acting on the spreader mechanism to pivot the spreader mechanism to the blocking position, and in the closed position the shank guide members block the leg of the spreader mechanism from passing therebetween under the spring bias acting on the spreader mechanism to pivot the spreader mechanism from the unblocking position to the blocking position.

9. The apparatus claimed in claim 8 wherein the shank guide members have rearwardly directed camming surfaces, wherein on moving the housing forwardly toward the workpiece after the screw is driven sufficiently forwardly into the workpiece an enlarged diameter portion of the screw rearward on the screw from the shaft engages the camming surfaces of the shank guide members to pivot the shank guide members to the open position whereupon the spreader mechanism is pivoted under its spring bias to move the leg in between the shank guide members, wherein on moving the housing further forwardly toward the workpiece sufficiently that the screw passes forwardly past the shank guide members, the shank guide members are kept in the open position against closing under their spring bias to assume the closed position by the leg engaged therebetween, wherein on moving the housing further forwardly toward the workpiece sufficiently that the screw is substantially fully driven into the workpiece, the screw feed activation mechanism after advancing a next screw between the shank guide members into alignment with the axis pivots the spreader mechanism toward the unblocked position sufficiently to move the leg from between the shank guide members permitting the shank guide members to move under their spring bias to the closed position about the shaft of the next screw and the spreader mechanism to move under its spring bias to the unblocked position, wherein on moving the housing further forwardly toward the workpiece sufficiently that the screw passes forwardly past the shank guide members, the shank guide members are kept in the open position against closing under their spring bias to assume the closed position by the leg engaged therebetween, wherein on moving the housing further forwardly toward the workpiece sufficiently that the screw is substantially fully driven into the workpiece, the screw feed activation mechanism after advancing a next screw between the shank guide members into alignment with the axis moves the spreader mechanism toward the unblocked position thereby moving the leg from between the shank guide members permitting the shank guide members to move under their spring bias to the closed position about the shaft of the next screw.

10. The apparatus claimed in claim 1 wherein: (a) in the open position the shank guide members are spaced apart from each other sufficiently that the leg may pass therebetween on the spreader mechanism moving from the unblocked position to the blocking position, and (b) in the closed position the shank guide members block the leg of the spreader mechanism from passing therebetween on moving the spreader mechanism from the unblocking position towards the blocking position, the shank guide members have rearwardly directed camming surfaces, wherein on moving the housing forwardly toward the workpiece after the screw is driven sufficiently forwardly into the workpiece an enlarged diameter portion of the screw rearward on the screw from the shaft engages the camming surfaces of the shank guide members to pivot the shank guide members to the open position whereupon the spreader mechanism is moved from the unblocking position toward the blocking position to move the leg in between the shank guide members, wherein on moving the housing further forwardly toward the workpiece sufficiently that the screw passes forwardly past the shank guide members, the shank guide members are kept in the open position against closing under their spring bias to assume the closed position by the leg engaged therebetween, and wherein on moving the housing further forwardly toward the workpiece sufficiently that the screw is substantially fully driven into the workpiece, the screw feed activation mechanism after advancing a next screw between the shank guide members into alignment with the axis moves the spreader mechanism toward the unblocked position thereby moving the leg from between the shank guide members permitting the shank guide members to move under their spring bias to the closed position about the shaft of the next screw.

11. The apparatus claimed in claim 1 including a lever for manual engagement to move at least one of the pair of shank guide members mounted to the open position, and wherein with the at least one of the pair of shank guide members in the open position, the shank guide members defining an insertion passageway through which the shank can be moved between a position with the shank between the shank guide members axially in alignment with said drive shaft and a position in which the shank is removed from between the shank guide members.

12. The apparatus claimed in claim 1 including a lever for manual engagement to move at least one of the pair of shank guide members mounted to the open position, and wherein with the at least one of the pair of shank guide members in the open position the shank guide members defining an insertion passageway through which by manual sliding of the screwstrip within the guide channel:

(a) the screwstrip can be engaged with the slide body with the shank advanced to a position with the shank between the shaft guide members axially in alignment with said drive shaft, and (b) the screwstrip can removed from engagement with the slide body with the shank withdrawn from between the shaft guide members.

13. The apparatus claimed in claim 12 wherein the screw feed mechanism engages the screwstrip to advance the successive screws through the guide channel to the initial screw position and to maintain the screwstrip against withdrawal with each successive screw in the initial screw position, while the slide body is in the extended position relative the housing, the movement of the at least one of the pair of shank guide members to the open position disengages the screw feed mechanism from maintaining the screwstrip against withdrawal.

14. The apparatus claimed in claim 13 wherein the screw feed mechanism includes a pawl member to maintain the screwstrip against withdrawal, while the slide body is in the extended position relative the housing, the movement of the at least one of the pair of shank guide members to the open position disengages the pawl member from maintaining the screwstrip against withdrawal, and when the pawl member is so disengaged on relative movement of the slide body relative the housing out of the extended position, the pawl member is released from being disengaged.

15. The apparatus claimed in claim 14 wherein the pawl member is movable between a first position in which it engages the screwstrip to maintain the screwstrip against withdrawal and a second position in which the pawl member is disengaged from maintaining the screwstrip against withdrawal, the pawl member resiliently biased to assume the first position when moved from the first position toward the second position.

16. An apparatus for driving with a power driver a screwstrip comprising threaded screws which are joined together in a strip comprising:

a housing;

an elongate drive shaft for operative connection to a power driver for rotation thereby and defining a longitudinal axis;

a bit at a forward end of the drive shaft for engagement with a head of a screw, a slide body coupled to the housing for displacement parallel to the axis of the drive shaft between an extended position and a retracted position;

the slide body having:

(a) a guide channel for said screwstrip extending through said slide body generally transverse to the axis;

(b) a screw feed activation mechanism coupled between the slide body and the housing whereby displacement of the slide body relative the housing between the extended position and the retracted position advances successive screws through the guide channel to an initial screw position axially in alignment with said drive shaft for engagement in driving of each screw by the bit carried at the forward end of the drive shaft forwardly into a workpiece, and (c) a forwardly directed touch down foot to engage the workpiece;

wherein with the slide body in the extended position relative the housing the screw in the initial screw position extends forwardly to a tip of the screw, wherein from the extended position with the screw in the initial screw position with moving of the housing forwardly toward the workpiece the touch down foot engages the workpiece, whereupon with forward movement of the housing toward the workpiece engagement of the touch down foot with the workpiece causes the housing to move relative the slide body towards the retracted position such that the bit in engagement with the head of the screw drives the screw into the workpiece, wherein the slide body includes a pair of shank guide members, each shank guide member engaging a shank of the screw spaced forwardly from the head of the screw toward the tip to locate the shank axially in alignment with said drive shaft and the shaft of the screw is engaged by each of the shank guide members rearward of the touch down foot, each of the shank guide members is mounted to the slide body for relative movement between a closed position and an open position, in the closed position, the shank guide members positioned to entrap therebetween the shank of the screw to locate the shank axially in alignment with said drive shaft, and in the open position, the shank guide members defining an access passageway through which the shank is advanced by the screw feed activation mechanism to a position with the shank between the shank guide members axially in alignment with said drive shaft, wherein on moving the housing forwardly toward the workpiece after the screw is driven sufficiently forwardly into the workpiece the shank guide members are moved to the open position to permit the screw and driver shaft to pass forwardly therepast, wherein each of the shank guide members is pivotably mounted to the slide body for pivoting between the closed position and the open position, in the open position the shank guide members spaced apart from each other defining the access passageway therebetween, in the closed position, the shank guide members closing the access passageway.

17. An apparatus as claimed in aimed in claim 16 wherein the pair of shank guide members comprises a right shank guide member and a left shank guide member, the right shank guide member pivotally mounted to the body for pivoting between the closed position and the open position about a left axis disposed spaced on a left side from the axis of the drive shaft, and the left shank guide member pivotally mounted to the body for pivoting between the closed position and the open position about a right axis disposed spaced on a right side from the axis of the drive shaft, each of the left axis and the right axis being normal to the axis of the driver shaft, the left shank guide member having a left half guide tube and the right shank guide member having a right half guide tube, each half guide tube disposed coaxially about the axis of the drive shaft, the left guide tube and the right guide tube being complementary such that the left and right half guide tubes together encircle the shank of the screw to entrap therebetween the shank of the screw to locate the shank in axial alignment with the drive shaft when the shank guide members are in the closed position.

18. An apparatus as claimed in claim 17 wherein the slide body carries a spreader mechanism to maintain the shank guide members in the open position after the screw has been driven past the shank guide members until the screw feed activation mechanism advances a next screw in the strip adjacent the screw being driven to the initial position, wherein the spreader mechanism includes a spreader member movable between an unblocking position and a blocking position, in the blocking position the spreader mechanism having a leg received between the shank guide members maintaining the shank guide members in the open position against movement to the closed position, the spreader mechanism is pivotally mounted to the slide body for pivoting between the unblocked position and the blocked position about a spreader axis normal the axis of the drive shaft and normal to the left axis and the right axis about which the shank guide members are pivotable, the spreader axis being spaced from the axis of the drive shaft on the side of the drive axis opposite the side of the axis of the drive shaft that the screw feed activation mechanism advances successive screws through the guide channel.

19. An apparatus as claimed in claim 18 wherein the forwardly directed touch down foot is carried on the slide body for the forward end of the slide body forward of the shank guide members and the spreader mechanism.

* * * * *